US006677289B1

(12) United States Patent
Price et al.

(10) Patent No.: US 6,677,289 B1
(45) **Date of Patent: *Jan. 13, 2004**

(54) LAUNDRY DETERGENT COMPOSITIONS COMPRISING POLYAMINES AND MID-CHAIN BRANCHED SURFACTANTS

(75) Inventors: Kenneth Nathan Price, Cincinnati, OH (US); Eugene Paul Gosselink, Cincinnati, OH (US); Randall Scott Deinhammer, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 197 days.

This patent is subject to a terminal disclaimer.

(21) Appl. No.: 09/980,798

(22) PCT Filed: Jul. 13, 2000

(86) PCT No.: PCT/US00/19150

§ 371 (c)(1),
(2), (4) Date: Dec. 3, 2001

(87) PCT Pub. No.: WO01/05924

PCT Pub. Date: Jan. 25, 2001

Related U.S. Application Data

(60) Provisional application No. 60/160,288, filed on Oct. 19, 1999, and provisional application No. 60/144,170, filed on Jul. 16, 1999.

(51) Int. Cl.[7] ..... C11D 1/83; C11D 3/30; C11D 3/395; C11D 3/39

(52) U.S. Cl. ..... 510/303; 510/309; 510/340; 510/350; 510/351; 510/352; 510/372; 510/375; 510/376; 510/499

(58) Field of Search ..... 510/303, 309, 510/311, 340, 350, 351, 352, 372, 375, 376, 499; 564/281, 290, 295

(56) References Cited

U.S. PATENT DOCUMENTS

| | | | | |
|---|---|---|---|---|
| 3,642,572 A | | 2/1972 | Endres et al. | |
| 4,144,123 A | | 3/1979 | Scharf et al. | |
| 4,371,674 A | | 2/1983 | Hertel et al. | |
| 4,664,848 A | * | 5/1987 | Oh et al. | 252/547 |
| 5,451,341 A | | 9/1995 | White | |
| 5,565,145 A | | 10/1996 | Watson et al. | |
| 5,858,348 A | | 1/1999 | Matsuda et al. | |
| 6,004,922 A | | 12/1999 | Watson et al. | |
| 6,008,181 A | | 12/1999 | Cripe et al. | |
| 6,015,781 A | | 1/2000 | Vinson et al. | |
| 6,020,303 A | | 2/2000 | Cripe et al. | |
| 6,046,152 A | | 4/2000 | Vinson et al. | |
| 6,057,278 A | | 5/2000 | Gosselink et al. | |
| 6,060,443 A | | 5/2000 | Cripe et al. | |
| 6,066,612 A | | 5/2000 | Murata et al. | |
| 6,071,871 A | | 6/2000 | Gosselink et al. | |
| 6,075,000 A | | 6/2000 | Rohrbaugh et al. | |
| 6,087,316 A | | 7/2000 | Watson et al. | |
| 6,093,856 A | | 7/2000 | Cripe et al. | |
| 6,121,226 A | | 9/2000 | Gosselink et al. | |
| 6,133,222 A | | 10/2000 | Vinson et al. | |
| 6,153,577 A | | 11/2000 | Cripe et al. | |
| 6,191,093 B1 | | 2/2001 | Watson et al. | |
| 6,228,829 B1 | | 5/2001 | Vinson et al. | |
| 6,232,282 B1 | | 5/2001 | Kvietok et al. | |
| 6,242,406 B1 | | 6/2001 | Katsuda et al. | |
| 6,274,540 B1 | | 8/2001 | Scheibel et al. | |
| 6,281,181 B1 | | 8/2001 | Vinson et al. | |
| 6,291,415 B1 | | 9/2001 | Watson et al. | |
| 6,306,817 B1 | | 10/2001 | Kott et al. | |
| 6,326,348 B1 | | 12/2001 | Vinson et al. | |
| 6,369,024 B1 | | 4/2002 | Panandiker et al. | |
| 6,380,143 B1 | | 4/2002 | Kvietok et al. | |
| 6,444,633 B2 | | 9/2002 | Price | |
| 6,448,213 B1 | | 9/2002 | Willman | |
| 6,472,359 B1 | | 10/2002 | Ghosh | |
| 6,479,451 B2 | | 11/2002 | Price | |
| 6,482,789 B1 | | 11/2002 | Kvietok et al. | |
| 6,498,134 B1 | | 12/2002 | Vinson et al. | |
| 6,506,717 B1 | | 1/2003 | Kott et al. | |
| 6,525,012 B2 | * | 2/2003 | Price et al. | 510/321 |
| 6,566,319 B1 | | 5/2003 | Scheibel et al. | |

FOREIGN PATENT DOCUMENTS

| | | |
|---|---|---|
| EP | 0 122 593 | 7/1989 |
| EP | 0 269 169 B1 | 8/1992 |
| WO | WO 97/23546 | 7/1997 |
| WO | WO 97/42283 | 11/1997 |
| WO | WO 97/42284 | 11/1997 |
| WO | WO 97/42286 | 11/1997 |
| WO | WO 97/42287 | 11/1997 |
| WO | WO 98/15607 | 4/1998 |
| WO | WO 99/05082 | 2/1999 |
| WO | WO 99/05084 | 2/1999 |
| WO | WO 99/05242 | 2/1999 |
| WO | WO 99/19429 | 4/1999 |
| WO | WO 99/19434 | 4/1999 |
| WO | WO 99/19439 | 4/1999 |
| WO | WO 99/19443 | 4/1999 |
| WO | WO 99/19444 | 4/1999 |
| WO | WO 99/19448 | 4/1999 |
| WO | WO 99/19449 | 4/1999 |
| WO | WO 99/19450 | 4/1999 |
| WO | WO 99/19451 | 4/1999 |
| WO | WO 99/19453 | 4/1999 |
| WO | WO 99/19454 | 4/1999 |

* cited by examiner

*Primary Examiner*—Gregory Delcotto
(74) *Attorney, Agent, or Firm*—Laura R. Grunzinger; Kim W. Zerby; Steven W. Miller

(57) ABSTRACT

The present invention relates to detergent compositions comprising a mid-chain branched surfactant and also containing a bleaching agent, aluminosilicate, silicate, and/or detersive enzyme.

19 Claims, No Drawings

LAUNDRY DETERGENT COMPOSITIONS COMPRISING POLYAMINES AND MID-CHAIN BRANCHED SURFACTANTS

This application claims priority from PCT International Application Ser. No. PCT/US00/19150, filed Jul. 13, 2000, which claims priority to U.S. provisional application No. 60/144,170, filed Jul. 16, 1999, and to U.S. provisional application No. 60/160,288, filed Oct. 19, 1999.

FIELD OF THE INVENTION

The present invention relates to laundry detergent compositions which provide enhanced hydrophilic soil, inter alia, clay, removal benefits. The laundry detergent compositions of the present invention combine polyamines and a surfactant system which comprises mid-chain branched surfactants inter alia mid-chain branched alkyl sulfates. The laundry detergent compositions of the present invention may take any form, inter alia, solid, including granular, powder, tablet, bar, or liquid, including gels, paste, thixotropic liquids. The present invention further relates to methods for cleaning fabric having heavy clay soil deposits.

BACKGROUND OF THE INVENTION

Fabric, especially clothing, can become soiled with a variety of foreign substances ranging from hydrophobic stains (grease, oil) to hydrophilic stains (clay). The level of cleaning which is necessary to remove said foreign substances depends to a large degree upon the amount of stain present and the degree to which the foreign substance has contacted the fabric fibers. Grass stains usually involve direct abrasive contact with vegetative matter thereby producing highly penetrating stains. Clay soil stains, although in some instances contacting the fabric fibers with less force, nevertheless provide a different type of soil removal problem due to the high degree of charge associated with the clay itself. This high surface charge density may act to repel some laundry adjunct ingredients, inter alia, clay dispersants, thereby resisting any appreciable peptization and dispersal of the clay into the laundry liquor.

A surfactant per se is not all that is necessary to remove unwanted clay soils and stains. In fact, most surfactants by themselves in water are surprisingly poor at removing clay soils from fabric not all surfactants work equally well on all types of stains. In addition to surfactants, polyamine-based hydrophilic soil dispersants are added to laundry detergent compositions to "carry away" clay soils from the fabric surface and to stabilize the removed particles in solution sufficiently to minimize the possibility that the clay soil will be re-deposited upon the fabric. However, unless the clay can be initially removed from the soiled fabric, especially in the case of hydrophilic fibers, inter alia, cotton, there will be nothing in solution for the dispersants to bind to and keep suspended.

There is a long felt need in the art for laundry detergent compositions which can effectively break up and remove embedded clay and other hydrophilic soils from fabric. In addition, as the concentration of hydrophilic soil increases in the laundry liquor, there is a need for a surfactant system which will be able to handle this increased soil load. Also there is a long felt need for a clay soil active adjunct ingredient which can be optimized to fit the particular laundry detergent embodiment, inter alia, granular, liquid, and which can be therefore tailored to match the surfactant system. There has further been a long felt need for a method for cleaning hydrophilic soils from fabric wherein the hydrophilic soils are effectively peptized, dispersed, and suspended in the laundry liquor.

SUMMARY OF THE INVENTION

The present invention meets the aforementioned needs in that it has been surprisingly discovered that certain polyamine-based agents, also referred to herein as "polyamines", in combination with a surfactant system comprising one or more mid-chain branched surfactants provides enhanced removal of clay and other hydrophilic soils from fabric.

The first aspect of the present invention relates to a laundry detergent composition comprising:

a) from about 0.01%, preferably from about 0.1%, more preferably from 1%, most preferably from 2% to about 20%, preferably to about 10%, more preferably to about 5% by weight, of a polyamine, said polyamine selected from the group consisting of:
   i) polyamines comprising two or more backbone nitrogens;
   ii) polyamines comprising one or more cationic backbone nitrogens;
   iii) polyamines comprising one or more alkoxylated backbone nitrogens;
   iv) polyamines comprising one or more cationic backbone nitrogens and one or more alkoxylated backbone nitrogens; and
   v) mixtures thereof;

b) from about 0.01%, preferably from about 0.1% more preferably from about 1% to about 100%, preferably to about 80% by weight, preferably to about 60%, most preferably to about 30% by weight, of a surfactant system comprising:
   i) from 0% to 80% by weight, of a mid-chain branched alkyl sulfate surfactant selected from the group consisting of surfactants having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M,$$

the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z(OR^3)_mOSO_3M,$$

and mixtures thereof; wherein R, $R^1$, and $R^2$ are each independently hydrogen, $C_1$–$C_3$ alkyl, and mixtures thereof, provided the total number of carbon atoms in said surfactant is from 14 to 20 and at least one of R, $R^1$, and $R^2$ is not hydrogen; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is ethylene, 1,2-propylene, 1,3-propylene, 1,2-butylene, 1,4-butylene, and mixtures thereof; the average value of the index m is at least about 0.01;

ii) from 0% to 80% by weight, of a mid-chain branched aryl sulfonate surfactant having the formula:

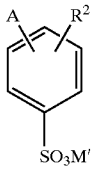

wherein A is a mid-chain branched alkyl unit having the formula:

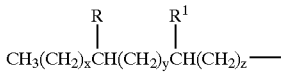

wherein R and $R^1$ are each independently hydrogen, $C_1$–$C_3$ alkyl, and mixtures thereof, provided the total number of carbon atoms in said alkyl unit is from 6 to 18 and at least one of R and $R^1$ is not hydrogen; x is an integer from 0 to 13; y is an integer from 0 to 13; z is 0 or 1; $R^2$ is hydrogen, $C_1$–$C_3$ alkyl, and mixtures thereof; M' is a water soluble cation with sufficient charge to provide neutrality;

iii) optionally from 0.01% by weight, of a surfactant selected from the group consisting of anionic, nonionic, cationic, zwitterionic, ampholytic surfactants, and mixtures thereof; and c) the balance carriers and adjunct ingredients.

The present invention also relates to hydrophilic soil cleaning systems which comprise polyamines which can be tailored to the specific surfactant system or laundry detergent form, i.e., liquid, granular.

The present invention further relates to laundry detergent compositions which are effective in removing clay-like soils under circumstances of high soil loading or high water hardness.

The present invention also relates to a method for removing hydrophilic stains from fabric by contacting fabric in need of cleaning with a composition according to the present invention.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to the surprising discovery that the combination of a polyamine and a surfactant system which comprises at least one mid-chain branched surfactant provides enhanced benefits for removal of clay soil from fabric especially clothing. It has been surprisingly discovered that the formulator, by selecting the molecular weight of the parent backbone, relative degree of quaternization, relative amount of N-oxide formation of the polyamine backbone, the type and relative degree of units which substitute the polyamine backbone, inter alia, cationic, anionic, and the nature of the amine backbone itself, inter alia, polyhexyleneimine, the formulator is able to form a polymer which can be tailored for optimization depending upon the desired execution. For example, the formulator may opt to use one type of polymer for a liquid embodiment targeted for use in a high soil loading context and another polymer for use in a granular detergent used for washing fabric in cold water.

Without wishing to be bound by theory it is believed the polyamines of the present invention interact with the mid-chain branched surfactants in a manner which makes the adsorption in the clay more efficacious by changing the anionic nature of the surface. It is believed this system is more effective in peptizing or breaking up the clay aggregates on the surface, thus allowing the inherent agitation associated with the laundry process (for example, the agitation provided by an automatic washing machine) act to break the surface-modified particles loose from the fabric surface and disperse them into solution. The clay and other hydrophilic particles which are removed by the compositions of the present invention are those types of stains or particles which are not well removed by normal surfactant/dispersant systems.

Although other surfactants, inter alia, non mid-chain branched sulphonates and sulphates, nonionic surfactants, are highly desirable components of the herein described granular laundry detergent compositions, their absence or presence does not affect the ability of the polyamine/mid-chain branched surfactant system to enhance clay soil removal.

The laundry detergent compositions of the present invention may take any form, for example, solid, including granular, powder, tablet, or liquid, including gels, paste, thixotropic liquids, etc.

The following is a detailed description of the required elements of the present invention.

POLYAMINES

The polyamines of the present invention comprise from 0.01%, preferably from about 0.1%, more preferably from 1%, most preferably from 2% to about 20%, preferably to about 10%, more preferably to about 5% by weight, of the compositions of the present invention. Suitable polyamines for use with mid-chain branched surfactants are polyamines selected from the group consisting of:

i) polyamines comprising two or more backbone nitrogens;

ii) polyamines comprising one or more cationic backbone nitrogens;

iii) polyamines comprising one or more alkoxylated backbone nitrogens;

iv) polyamines comprising one or more cationic backbone nitrogens and one or more alkoxylated backbone nitrogens; and v) mixtures thereof.

The polymers of the present invention are suitable for use in compositions which may take any form, for example, solids (i.e., powders, granules, extrudates, tablets), gels, thixotropic liquids, and pourable liquids (i.e., dispersions, isotropic solutions).

The polymers of the present invention are comprised of a polyamine backbone wherein the backbone units which connect the amino units can be modified by the formulator to achieve varying levels of product enhancement, inter alia, boosting of clay soil removal by surfactants, greater effectiveness in high soil loading usage. In addition to modification of the backbone compositions, the formulator may preferably substitute one or more of the backbone amino unit hydrogens by other units, inter alia, alkyleneoxy units having a terminal anionic moiety. In addition, the nitrogens of the backbone may be oxidized to the N-oxide. Preferably at least two of the nitrogens of the polyamine backbones are quaternized.

For the purposes of the present invention "cationic units" are defined as "units which are capable of having a positive charge". For the purposes of the polyamines of the present invention the cationic units are the quaternary ammonium nitrogens of the polyamine backbones or quaternary ammonium units which comprise the units which substitute the polyamine backbone. For the purposes of the present invention "anionic units" are defined as "units which are capable of having a negative charge". For the purposes of the polyamines of the present invention the anionic units are "units which alone, or as a part of another unit, substitute for hydrogens along the polyamine backbone" a non-limiting example of which is a $—(CH_2CH_2O)_{20}SO_3Na$ which is capable of replacing a backbone hydrogen on a nitrogen or oxygen atom.

1. Modified Polyalkyleneimines

One type of preferred polyamine according to the present invention are polyalkyleneimines having the formula:

$$[J—R]_n—J$$

wherein the [J—R] units represent the amino units which comprise the main backbone and any branching chains. Preferably the polyamines prior to modification, inter alia, quaternization, substitution of a backbone unit hydrogen with an alkyleneoxy unit, have backbones which comprise from 3 to about 100 amino units. The index n which describes the number of backbone units present is further described herein below.

J units are the backbone amino units, said units are selected from the group consisting of:

i) primary amino units having the formula:

$$(R^1)_2N;$$

ii) secondary amino units having the formula:

$$—R^1N;$$

iii) tertiary amino units having the formula:

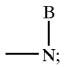

iv) primary quaternary amino units having the formula:

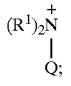

v) secondary quaternary amino units having the formula:

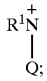

vi) tertiary quaternary amino units having the formula:

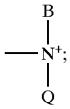

vii) primary N-oxide amino units having the formula:

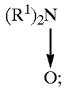

viii) secondary N-oxide amino units having the formula:

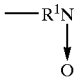

ix) tertiary N-oxide amino units having the formula:

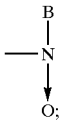

x) and mixtures thereof.

B units which have the formula:

$$[J—R]—$$

represent a continuation of the polyamine backbone by branching. The number of B units present, as well as, any further amino units which comprise the branches are reflected in the total value of the index n.

For the purpose of the present invention the term "substituted" is defined herein as "compatible moieties which replace a hydrogen atom". Non-limiting examples of substituents are hydroxy; nitrilo; oximino; halogen; nitro; carboxyl, inter alia, —CHO, $CO_2H$, $—CO_2R'$, $—CONH_2$, —CONHR'; $—CONR'_2$, wherein R' is $C_1$–$C_{12}$ linear or branched alkyl; amino; $C_1$–$C_{12}$ mono and di-alkylamino; $—OSO_3M$; $—SO_3M$; $—OPO_3M$; —OR" wherein R" is $C_1$–$C_{12}$ linear or branched alkyl; and mixtures thereof.

The backbone amino units of the polymers are connected by one or more R units, said R units are selected from the group consisting of:

i) $C_2$–$C_{12}$ linear alkylene, $C_3$–$C_{12}$ branched alkylene, $C_6$–$C_{16}$ substituted or unsubstituted arylene, $C_7$–$C_{40}$ substituted or unsubstituted alkylenearylene having the formula:

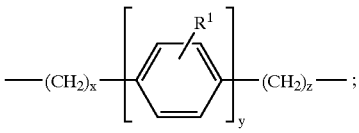

or mixtures thereof. When R is linear alkylene R is preferably $C_2$–$C_6$ alkylene. However, preferred embodiments of the present invention combine R units which are linear alkylene with one or more of the other R units listed herein below. When R is branched alkylene R is preferably 1,2-propylene, 1,2-butylene, 1,2-hexylene, and mixtures thereof. When R is substituted or unsubstituted phenylene, R is preferably 1,4-phenylene. When two adjacent nitrogens of the polyamine backbone are N-oxides, preferably the alkylene backbone unit which separates said units are $C_4$ units or greater. When R units comprise only linear or branched alkylene units, a preferred embodiment of the present invention relates to mixed linear and branched units, for example, units having backbones with the repeating formula:

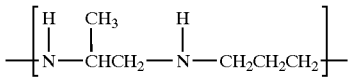

wherein the hydrogen atoms bonded to the backbone nitrogens may be substituted by any of the herein below described units. The formulator may also wish to provide lower molecular weight highly branched backbones by incorporating units having, for example, branched units having the formula:

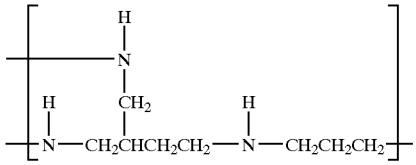

wherein said backbone branching is not provided by a secondary amino unit, secondary quaternary amino unit, or secondary N-oxide J unit as described herein above but instead is branched in the R backbone unit itself.

ii) alkyleneoxyalkylene units having the formula:

$$-(R^2O)_w(R^3)-$$

wherein $R^2$ is selected from the group consisting of ethylene, 1,2-propylene, 1,3-propylene, 1,2-butylene, 1,4-butylene, and mixtures thereof; $R^3$ is $C_2$–$C_8$ linear alkylene, $C_3$–$C_8$ branched alkylene, phenylene, substituted phenylene, and mixtures thereof; the index w is from 0 to about 25. $R^2$ and $R^3$ units may also comprise other backbone units. When comprising alkyleneoxyalkylene units $R^2$ and $R^3$ units are preferably mixtures of ethylene, propylene and butylene and the index w is from 1, preferably from about 2 to about 10, preferably to about 6. An example of a backbone comprising a mixture of $R^2$ units has the formula:

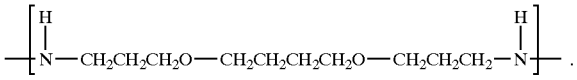

iii) hydroxyalkylene units having the formula:

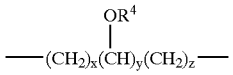

wherein $R^4$ is hydrogen, $C_1$–$C_6$ alkyl, $-(CH_2)_u(R^2O)_t(CH_2)_uY$, and mixtures thereof. When R units comprise hydroxyalkylene units, $R^4$ is preferably hydrogen or $-(CH_2)_u(R^2O)_t(CH_2)_uY$ wherein the index t is greater than 0, preferably from 10 to 30; the index u is from 0 to 6; and Y is preferably hydrogen or an anionic unit, more preferably $-SO_3M$. The indices x, y, and z are each independently from 0 to 20, preferably the indices are each at least equal to 1 and $R^4$ is hydrogen (2-hydroxypropylene unit) or $(R^2O)_tY$, or for polyhydroxy units y is preferably 2 or 3. A preferred hydroxyalkylene unit is the 2-hydroxypropylene unit which can, for example, be suitably formed from glycidyl ether forming reagents, inter alia, epihalohydrin. An example of an R unit which comprises the index y greater than 1 has the formula:

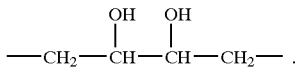

iv) hydroxyalkylene/oxyalkylene units having the formula:

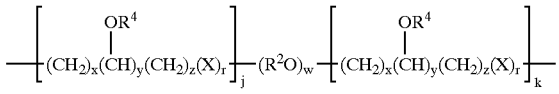

wherein $R^2$, $R^4$, and the indices w, x, y, and z are the same as defined herein above. X is oxygen or the amino unit $-NR^4-$, the index r is 0 or 1. The indices j and k are each independently from 1 to 20. When alkyleneoxy units are absent the index w is 0. Non-limiting examples of preferred hydroxyalkylene/oxyalkylene units have the formula:

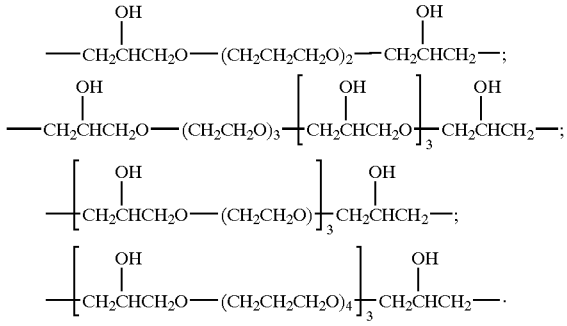

v) carboxyalkyleneoxy units having the formula:

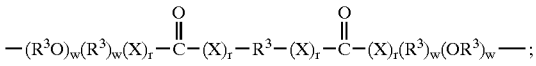

wherein $R^2$, $R^3$, X, r, and w are the same as defined herein above. Non-limiting examples of preferred carboxyalkyleneoxy units include:

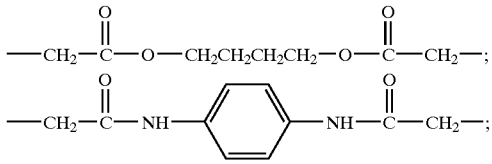

-continued

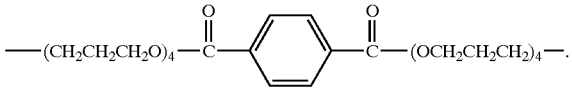

vi) backbone branching units having the formula:

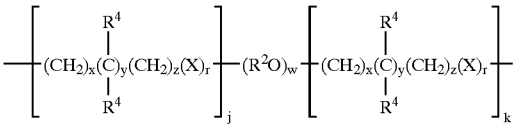

wherein $R^4$ is hydrogen, $C_1$–$C_6$ alkyl, —$(CH_2)_u(R^2O)_t(CH_2)_uY$, and mixtures thereof. When R units comprise backbone branching units, $R^4$ is preferably hydrogen or —$(CH_2)_u(R^2O)_t$—$(CH_2)^uY$ wherein the index t is greater than 0, preferably from 10 to 30; the index u is from 0 to 6; and Y is hydrogen, $C_1$–$C_4$ linear alkyl, —$N(R^1)_2$, an anionic unit, and mixtures thereof; preferably Y is hydrogen, or —$N(R^1)_2$. A preferred embodiment of backbone branching units comprises $R^4$ equal to —$(R^2O)_tH$. The indices x, y, and z are each independently from 0 to 20. vii) The formulator may suitably combine any of the above described R units to make a polyamine having a greater or lesser degree of hydrophilic character.

$R^1$ units are the units which are attached to the backbone nitrogens. $R^1$ units are selected from the group consisting of:

i) hydrogen; which is the unit typically present prior to any backbone modification.

ii) $C_1$–$C_{22}$ alkyl, preferably $C_1$–$C_4$ alkyl, more preferably methyl or ethyl, most preferably methyl. A preferred embodiment of the present invention in the instance wherein $R^1$ units are attached to quaternary units (iv) or (v), $R^1$ is the same unit as quaternizing unit Q. For example a J unit having the formula:

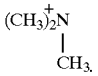

iii) $C_7$–$C_{22}$ arylenealkyl having the general formula:

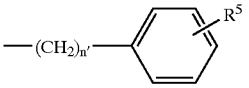

wherein $R^5$ is $C_1C_{16}$ linear or branched alkyl, n' is 0 or 1.

iv) $C_7$–$C_{22}$ alkylenearyl having the general formula:

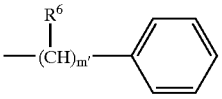

wherein $R^6$ is hydrogen, $C_1$–$C_{15}$ alkyl, and mixtures thereof; a preferred $R^1$ unit which is an alkylenearyl unit is benzyl; m' is from 1 to 16.

v) —$[CH_2CH(OR^4)CH_2O]_s(R^2O)_tY$; wherein $R^2$ and $R^4$ are the same as defined herein above, preferably when $R^1$ units comprise $R^2$ units, $R^2$ is preferably ethylene. The value of the index s is from 0 to 5. For the purposes of the present invention the index t is expressed as an average value, said average value from about 0.5 to about 100. The formulator may lightly alkyleneoxylate the backbone nitrogens in a manner wherein not every nitrogen atom comprises an $R^1$ unit which is an alkyleneoxy unit thereby rendering the value of the index t less than 1. For one embodiment herein the average value of the index t is from about 0.5 to 30, wherein for others the average value of the index t is from about 10 to about 30, for another embodiment from about 5 to about 15. The value of the index t allows the formulator to adjust the amount of alkyleneoxy units which are present and, therefore, may change due to the simple addition of a specific adjunct ingredient to the formulation.

vi) Anionic units as described herein below.

The formulator may suitably combine one or more of the above described $R^1$ units when substituting the backbone of the polymers of the present invention.

Q is a quaternizing unit selected from the group consisting of $C_1$–$C_4$ linear alkyl, benzyl, and mixtures thereof, preferably methyl. As described herein above, preferably Q is the same as $R^1$ when $R^1$ comprises an alkyl unit. For each backbone $N^+$ unit (quaternary nitrogen) there will be an anion to provide charge neutrality. The anionic groups of the present invention include both units which are covalently attached to the polymer, as well as, external anions which are present to achieve charge neutrality. Non-limiting examples of anions suitable for use include halogen, inter alia, chloride; methyl sulfate; hydrogen sulfate, and sulfate. The formulator will recognize by the herein described examples that the anion will typically be a unit which is part of the quaternizing reagent, inter alia, methyl chloride, dimethyl sulfate, benzyl bromide.

X is oxygen, —$NR^4$—, and mixtures thereof, preferably oxygen.

Y is hydrogen, $C_1$–$C_4$ linear alkyl, —$N(R^1)_2$, or an anionic unit. Y is —$N(R^1)_2$ preferably when Y is part of an R unit which is a backbone branching unit. Anionic units are defined herein as "units or moieties which are capable of having a negative charge". For example, a carboxylic acid unit, —$CO_2H$, is neutral, however upon de-protonation the unit becomes an anionic unit, —$CO_2^-$, the unit is therefore, "capable of having a negative charge. Non-limiting examples of anionic Y units include —$(CH_2)_fCO_2M$, —$C(O)(CH_2)_fCO_2M$, —$(CH_2)_fPO_3M$, —$(CH_2)_tOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, —$C(O)CH_2CH(CO_2M)NHCH_2CO_2M$, —$CH_2CH(OZ)CH_2O(R^1O)_t$ Z, —$(CH_2)_tCH$—$[O(R^2O)_tZ]CH_fO(R^2O)_tZ$, and mixtures thereof, wherein Z is hydrogen or an anionic unit non-limiting examples of which include —$(CH_2)_fCO_2M$, —$C(O)(CH_2)_fCO_2M$, —$(CH_2)_fPO_3M$, —$(CH_2)_fOPO_3M$, —$(CH_2)_f$ $SO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, and mixtures thereof, M is a cation which provides charge neutrality.

Y units may also be oligomeric or polymeric, for example, the anionic Y unit having the formula:

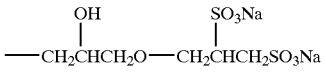

may be oligomerized or polymerized to form units having the general formula:

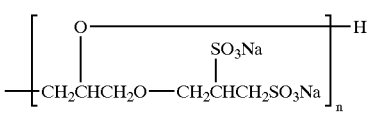

wherein the index n represents a number greater than 1.

Further non-limiting examples of Y units which can be suitably oligomerized or polymerized include:

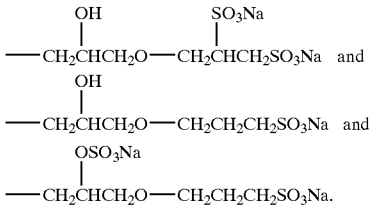

Certain embodiments of the present invention may require polyamines which comprise one or more anionic units which are substituted on the polyamine backbone. In general, for granular laundry detergent compositions which require a high degree of anionic charge, especially when the polyamine backbones are highly quaternized, preferably greater than about 40%, more preferably greater than 50%, yet more preferably more than 75%, most preferably greater than 90% of said Y units are —$SO_3M$ comprising units. For liquid laundry detergent compositions preferably less than about 90%, more preferably less than 75%, yet more preferably less than 50%, most preferably less than 40% of said Y units comprise an anionic moiety, inter alia, —$SO_3M$ comprising units. The number of Y units which comprise an anionic unit will vary from embodiment to embodiment. M is hydrogen, a water soluble cation, and mixtures thereof; the index f is from 0 to 6.

The index n represents the number of backbone units wherein the number of amino units in the backbone is equal to n+1. For the purposes of the present invention the index n is from 2 to about 1000. Branching units B are included in the total number of backbone units. For example, a backbone having the formula:

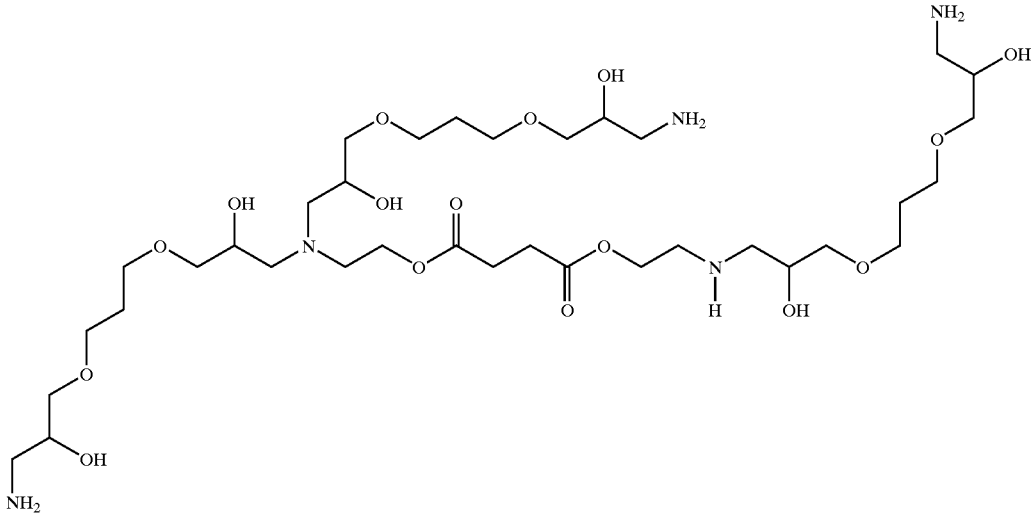

has an index n equal to 4. The following is a non-limiting example of a polyamine backbone which is fully quaternized.

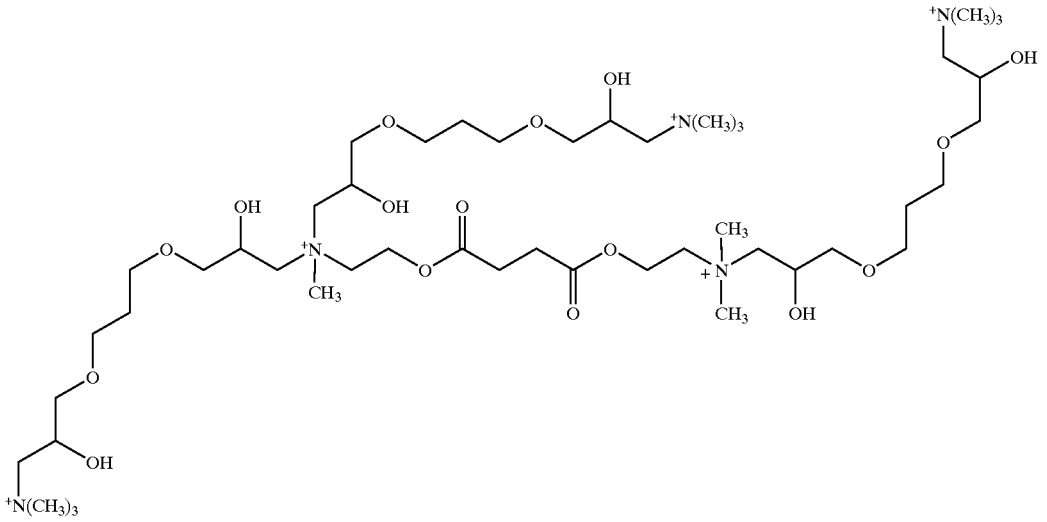

One class of polyamines which are suitable for use with the mid-chain branched surfactants of the present invention are the polymers comprising a PEI backbone wherein all substitutable nitrogens are modified by replacement of hydrogen with a polyoxyalkyleneoxy unit, —$(CH_2CH_2O)_{20}H$, having the formula:

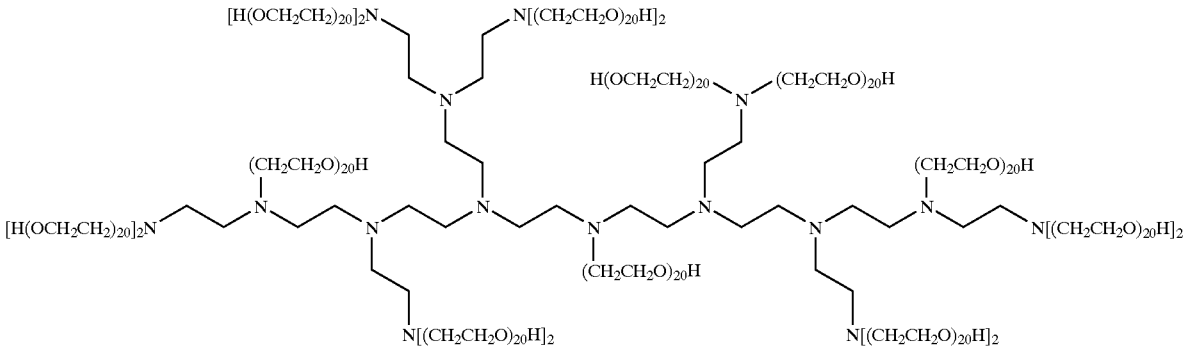

Another example of this type of polyamine is the polymer comprising a PEI backbone wherein all substitutable nitrogens are modified by replacement of hydrogen with a polyoxyalkyleneoxy unit, —$(CH_2CH_2O)_7H$, having the formula

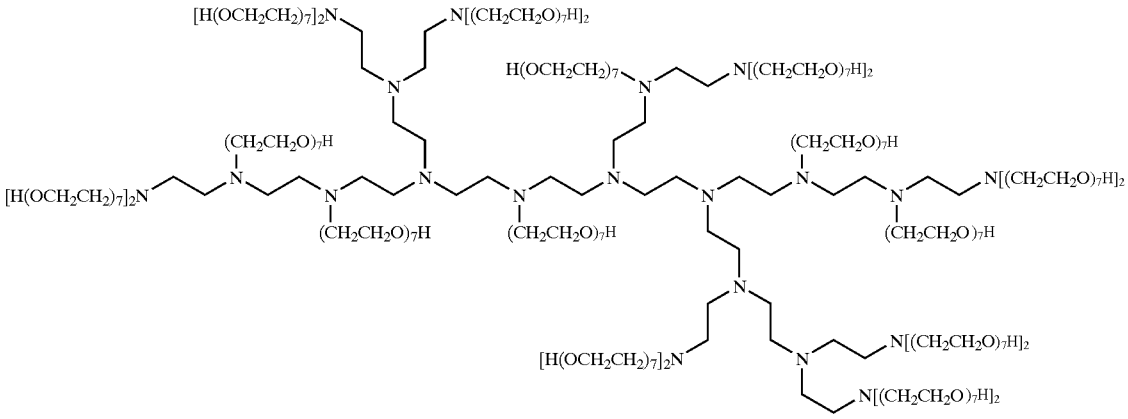

However, the formulator may desire a polyamine which will not be adulterated by the presence of bleach. One means available to mitigate against the effects of bleaching agents is to form N-oxides of the backbone nitrogens. The example below illustrates a polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides having the formula

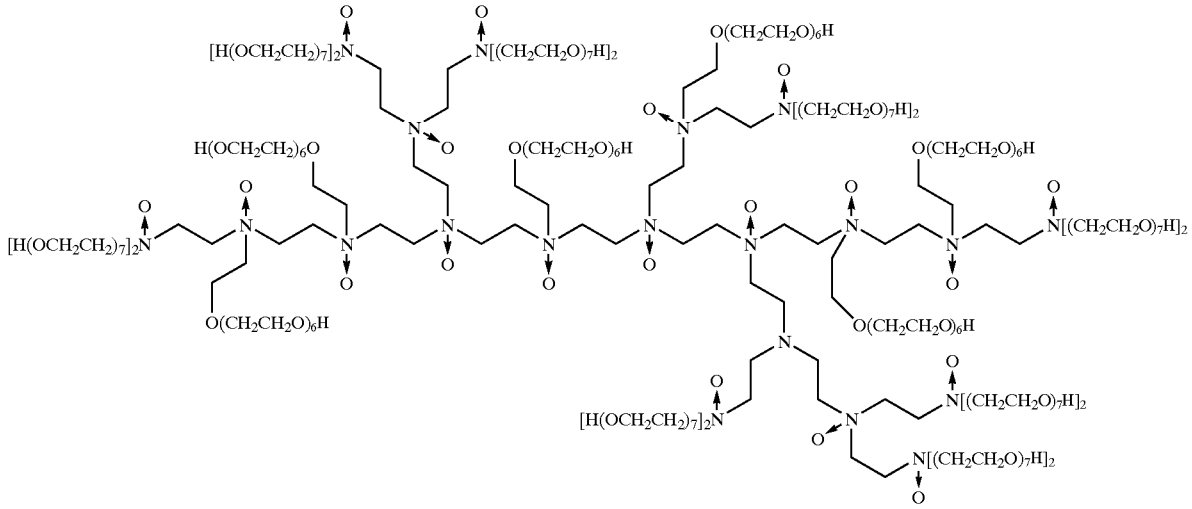

The presence of charged backbones, in the form of quaternary ammonium units, in many instances will enhance the performance of mid-chain branched surfactant comprising compositions. Illustrated below is a polymer which comprises a PEI backbone wherein all backbone hydrogen atoms are substituted and some backbone amine units are quaternized. The substituents are polyoxyalkyleneoxy units, —$(CH_2CH_2O)_7H$, or methyl groups. The modified, cationicly charged backbone polymer has the formula:

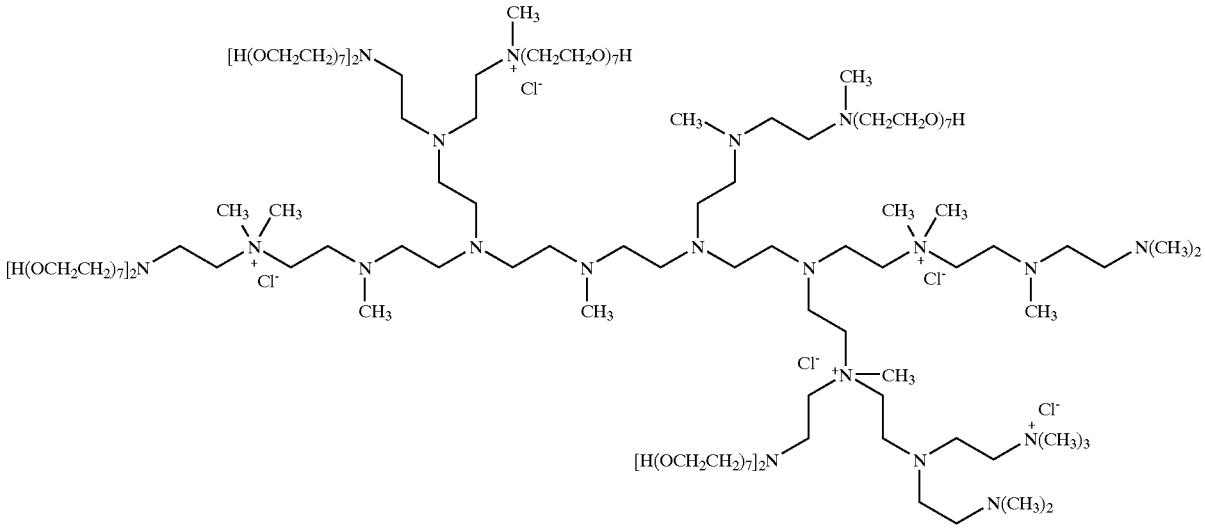

The following is a non-limiting example of a polyamine according to the present invention.

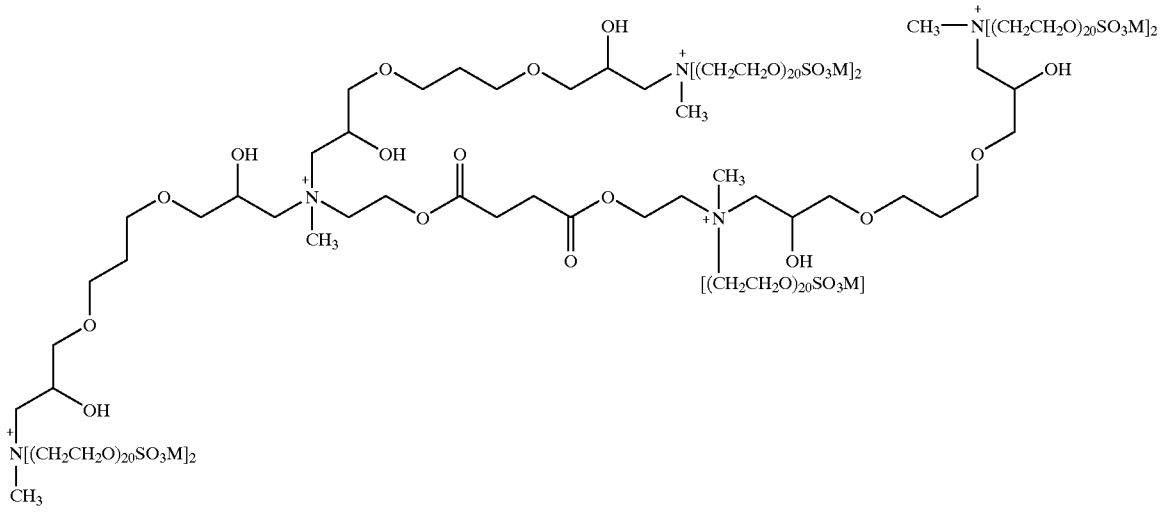

A preferred polyamine polymer according to the present invention, is the bleach stable polyamine which comprises no N-oxide units, having the formula:

$$[(R^1)_2N-R]_{w'}[\overset{R^1}{\overset{|}{N}}-R]_{x'}[\overset{B}{\overset{|}{N}}-R]_{y'}N(R^1)_2$$

wherein each R unit is an ethylene or propylene unit; $R^1$ units are $-[CH_2CH(OR^4)CH_2O]_s-(R^2O)_tY$ units; wherein $R^2$ is ethylene, 1,2-propylene, and mixtures thereof; Y is hydrogen, and the value of the index s is 0. Preferably the values of the indices w', x', and y' are such that the polyamine has a backbone molecular weight prior to modification of from 600 daltons to about 3000 daltons. Preferred backbone molecular weights are 600 daltons, 1200 daltons, 1800 daltons, and 3000 daltons.

An example of a preferred polyalkylene amine according to the present invention is a polyamine wherein each R is ethylene and the backbone has a molecular weight of about 3000 daltons and each hydrogen of the backbone amino units are substituted by a polyalkylene $R^1$ unit wherein either one or three 1,$^2$-propyleneoxy units are directly attached to the polyamine chain followed by sufficient ethyleneoxy units to provide an $R^1$ units which has an average of 30 alkyleneoxy units present.

Preferred polymers of the present invention have the formula:

$$[Y(OR^2)_t]_2-\overset{+}{\underset{Q}{N}}-R-\left[\overset{(R^2O)_tY}{\overset{|}{\overset{+}{N}}}-R-\overset{+}{\underset{Q}{N}}\right]_m-[(R^2O)_tY]_2$$

wherein R units have the formula $-(R^2O)_wR^3-$ wherein $R^2$ and $R^3$ are each independently selected from the group consisting of $C_2$–$C_8$ linear alkylene, $C_3$–$C_8$ branched alkylene, phenylene, substituted phenylene, and mixtures thereof. The $R^2$ units of the formula above, which comprise $-(R^2O)_tY$ units, are each ethylene; Y is hydrogen, $-SO_3M$, and mixtures thereof, the index t is from 15 to 25; the index m is from 0 to 20, preferably from 0 to 10, more preferably from 0 to 4, yet more preferably from 0 to 3, most preferably from 0 to 2; the index w is from 1, preferably from about 2 to about 10, preferably to about 6.

An example of a preferred R unit having the formula $-(R^2O)_wR^3-$ is the backbone:

$$-CH_2CH_2CH_2CH_2CH_2CH_2CH_2OCH_2CH_2CH_2-$$

wherein $R^2$ is propylene and butylene, $R^3$ is propylene, w is equal to 2.

Non-limiting examples of backbones according to the present invention include 1,9-diamino-3,7-dioxanonane; 1,10-diamino-3,8-dioxadecane; 1,12-diamino-3,10-dioxadodecane; 1,14-diamino-3,12-dioxatetradecane. However, backbones which comprise more than two nitrogens may comprise one or more repeating units having the formula:

$$H_2N-[R-NH]-$$

for example a unit having the formula:

$$H_2N-[CH_2CH_2OCH_2CH_2NH]-$$

is described herein as 1,5-diamino-3-oxapentane. A backbone which comprises two 1,5-diamino-3-oxapentane units has the formula:

$$H_2NCH_2CH_2OCH_2CH_2NHCH_2CH_2OCH_2CH_2NH_2.$$

Further suitable repeating units include 1,8-diamino-3,6-diaxaoctane; 1,11-diamino-3,6,9-trioxaundecane; 1,5-diamino-1,4-dimethyl-3-oxaheptane; 1,8-diamino-1,4,7-trimethyl-3,6-dioxaoctane; 1,9-diamino-5-oxanonane; 1,14-diamino-5,10-dioxatetradecane.

The present invention affords the formulator with the ability to optimize the polymer for a particular use or embodiment. Not wishing to be limited by theory, it is believed that the backbone quaternization (positive charge carriers) interact with the hydrophilic soils, inter alia, clay, and the anionic capping units of the $R^1$ units ameliorate the ability of surfactant molecules to interact, and therefore occupy, the cationic sites of the polymers. It is surprisingly found that the amount of anionic moieties needed vary from embodiment to embodiment. Heavy Duty Granular (HDG) compositions which comprise a high amount of linear alkylbenzene sulfonate (LAS) surfactant require a greater number of anionic units per se to be present in the polymers.

However, unexpectedly the polymers of the present invention provide a greater degree of clay removal when used with the same amount of a non-mid chain branched surfactant. Preferably, in HDG formulations, the polymer will have a net negative charge. For example, three quaternized backbone nitrogens will be present for every 5 —$SO_3M$ capping units.

Surprisingly, liquid embodiments (HDL) of the present invention are more effective in removing hydrophilic soils when the backbones comprise R units having a greater degree of alkylene unit character and which comprise a lower number of anionic units which cap the $R^1$ units than the backbones in their HDG counterpart embodiments.

The polymers of the present invention preferably comprise polyamine backbone which are derivatives of two types of backbone units:

i) normal oligomers which comprise R units of type (i), which are preferably polyamines having the formula:

$$H_2N—(CH_2)_{n+1}—[NH—(CH_2)_x]_m—[NB—(CH_2)_x]_n—NH_2$$

wherein B is a continuation of the polyamine chain by branching, n is preferably 0, m is from 0 to 3, x is 2 to 8, preferably from 3 to 6; and ii) hydrophilic oligomers which comprise R units of type (ii), which are preferably polyamines having the formula:

$$H_2N—[(CH_2)_xO]_y(CH_2)_x]—[NH—[(CH_2)_xO]_y(CH_2)_x]_m—NH_2$$

wherein m is from 0 to 3; each x is independently from 2 to 8, preferably from 2 to 6; y is preferably from 1 to 8.

Depending upon the degree of hydrophilic character needed in the backbones, the formulator may assemble higher oligomers from these constituent parts by using R units of types (iii), (iv), and (v). Non-limiting examples include the epihalohydrin condensate having the formula:

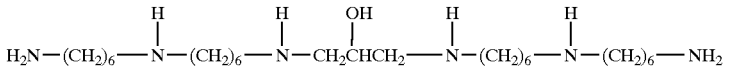

or the hybrid oligomer having the formula:

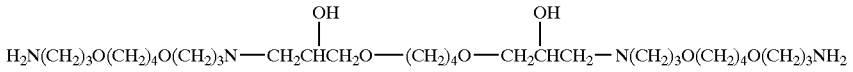

wherein each backbone comprises a mixture of R units.

As described herein before, the formulator may form polymers which have an excess of charge or an equivalent amount of charge type. An example of a preferred polyamine according to the present invention which has an excess of anionic charged units, has the formula:

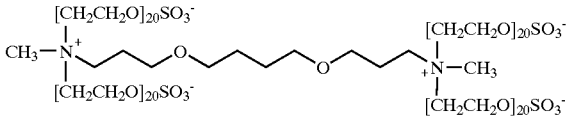

wherein R is a 1,3-propyleneoxy-1,4butyleneoxy-1,3-propylene unit, w is 2; $R^1$ is —$(R^2O)_tY$, wherein $R^2$ is ethylene, each Y is —$SO_3^-$, Q is methyl, m is 0, n is 0, t is 20. For polyamines of the present invention, it will be recognized by the formulator that not every $R^1$ unit will have a —$SO_3^-$ moiety capping said $R^1$ unit. For the above example, the final polyamine mixture comprises at least about 90% Y units which are —$SO_3^-$ units.

2. Crosslinked Polyamines

Another preferred class of polyamine suitable for use in the present invention, are polyamines which may be present as a formulated admixture or a product by process composition, or a mixture of both. These preferred compounds can be represented by the formulae:

i) $(PA)_w(T)_x$;

ii) $(PA)_w(L)_z$;

iii) $[(PA)_w(T)_x]_y[L]_z$;

wherein PA is a grafted or non-grafted, modified or unmodified polyamine backbone unit, T is an amide-forming polycarboxylic acid crosslinking unit, and L is a non-amide forming crosslinking unit. For compounds of type (i) and (iii) the relative amounts of PA units and T units which are present are such that the molar ratio of PA units to T units is from 0.8:1 to 1.5:1. For compounds of type (ii) the relative amounts of PA units and L units which are present are such that the $(PA)_w(L)_z$ comprises from about 0.05, preferably from about 0.3 to 2 parts by weight of said L units. Therefore, 1 part of a grafted or non-grafted, modified or unmodified polyamine backbone unit may be combined with from about 0.05, preferably from about 0.3 parts by weight of an L unit to about 2 parts by weight of an L unit to form a suitable modified polyamine compound. Likewise, for compounds of type (iii), crosslinked polyamines having the formula $PA)_w(T)_x$ may be combined with from about 0.05, preferably from about 0.3 parts by weight of an L unit to about 2 parts by weight of an L unit to form a suitable modified polyamine compound having the formula $[(PA)_w(T)_x]_y[L]_z$.

Polyamine Backbone (PA Units)

The modified polyamine compounds of the present invention comprise a Polyamine Backbone, PA unit, which can be optionally, but preferably grafted. The following are non-limiting examples of suitable PA units according to the present invention.

Polyalkyleneimine

A preferred PA unit according to the present invention are polyalkyleneimines and polyalkyleneamines having the general formula:

$$[H_2N-R]_w[\overset{H}{\overset{|}{N}}-R]_x[\overset{B}{\overset{|}{N}}-R]_yNH_2$$

wherein R is $C_2$–$C_{12}$ linear alkylene, $C_3$–$C_{12}$ branched alkylene, and mixtures thereof; B representing a continuation of the chain structure by branching. The indices w, x, and y have various values depending upon such factors as molecular weight and relative degree of branching. The polyalkyleneimines and polyalkyleneamines which comprise PA units of the present invention are divided into three categories based upon relative molecular weight. The terms polyalkyleneimine and polyalkyleneamines are used interchangeably throughout the present specification and are taken to mean polyamines having the general formula indicated above regardless of method of preparation.

Low Molecular Weight Polyalkyleneimines

For low molecular weight polyalkyleneimines having the formula:

$$[H_2N-R]_w[\overset{H}{\overset{|}{N}}-R]_x[\overset{B}{\overset{|}{N}}-R]_yNH_2$$

R is $C_2$–$C_{12}$ linear alkylene, $C_3$–$C_{12}$ branched alkylene, and mixtures thereof; preferably R is ethylene, 1,3-propylene, and 1,6-hexylene, more preferred is ethylene. The indices w, x, and y are such that the molecular weight of said polyamines does not exceed about 600 daltons. For example, for an entirely linear polyethyleneimine having a molecular weight of about 600 daltons, the index w=1, x=13, and y=0. For an entirely branched polyethyleneimine having a molecular weight of approximately 600 daltons, w=8, x=0 and y=7. (This combination of indices results in a material having an average molecular weight of about 646 daltons, which, for the purposes of the present invention is a low molecular weight polyalkyleneimine.) The index w typically has the value of y+1. The simplest of the low molecular weight polyamines of this type is ethylene diamine which may be present up to about 10% by weight of the PA unit mixture. Non-limiting examples of low molecular weight polyalkyleneimine PA units include diethylene triamine, triethylene tetramine, tetraethylene pentamine, dipropylene triamine, tripropylene tetramine, and dihexamethylene triamine. PA units may be used as crude products or mixtures, and if desired by the formulator, these PA units may be used in the presence of small amounts of diamines as described herein above, wherein the amount of diamines, inter alia, ethylene diamine, hexamethylene diamine may be present up to about 10% by weight, of the PA unit mixture.

Medium Range Molecular Weight Polyalkyleneimines

For medium range molecular weight polyalkyleneimines having the formula:

$$[H_2N-R]_w[\overset{H}{\overset{|}{N}}-R]_x[\overset{B}{\overset{|}{N}}-R]_yNH_2$$

R is $C_2$–$C_4$ linear alkylene, $C_3$–$C_4$ branched alkylene, and mixtures thereof; preferably R is ethylene, 1,3-propylene, and mixtures thereof, more preferred is ethylene wherein said polyamines are polyethyleneimines (PEI's). The indices w, x, and y are such that the molecular weight of said polyamines is from about 600 daltons to about 50,000 daltons. The indices w, x, and y will indicate not only the molecular weight of the polyalkyleneimines but also the degree of branching present in the PA unit backbone.

High Molecular Weight Polyalkyleneimines

For high molecular weight polyalkyleneimines having the formula:

$$[H_2N-R]_w[\overset{H}{\overset{|}{N}}-R]_x[\overset{B}{\overset{|}{N}}-R]_yNH_2$$

R is $C_2$–$C_3$ linear alkylene, preferably R is ethylene. The indices w, x, and y are such that the molecular weight of said polyamines is from about 50,000 daltons to about 1,000,000 (1 million) daltons. The indices w, x, and y will indicate not only the molecular weight of the polyalkyleneimines but also the degree of branching present in the PA unit backbone.

Co-polymeric Polyamines

Another example of a preferred PA unit according to the present invention are the polyvinyl amine homo-polymers or co-polymers having the formula:

$$-[V]_m-\left[CH_2\overset{NH_2}{\overset{|}{C}}H\right]_n-$$

wherein V is a co-monomer, non-limiting examples of which include vinyl amides, vinyl pyrrolidone, vinyl imidazole, vinyl esters, vinyl alcohols, and mixtures thereof, all of which can be taken together or in combination with polyvinyl amine to form suitable co-polymerization products suitable for use in the fabric enhancement systems of the present invention. The indices m and n are such that the copolymers comprise at least 10%, more preferably at least about 30% of units derived from vinyl amine and wherein further the molecular weight of said copolymers if from about 500 daltons, preferably from about 5,000 daltons to about 50,000 daltons, preferably to about 20,000 daltons.

Polyamine Backbone Modifications

Optionally, but preferably, the PA units of the present invention are modified either before or after reaction with a T unit or L unit crosslinking agent. The two preferred types of modifications are grafting and capping.

Preferably the PA units of the present invention are grafted, that is the PA unit is further reacted with a reagent which elongates said PA unit chain, preferably by reaction of the nitrogens of the PA backbone unit with one or more equivalents of aziridine (ethyleneimine), caprolactam, and mixtures thereof. Grafting units, in contrast to the "capping" units described herein below, can further react on themselves to provide PA unit chain propagation. An example of a preferred grafted PA unit of the present invention has the formula:

$$[G_2N-R]_w[\overset{G}{\overset{|}{N}}-R]_x[\overset{B}{\overset{|}{N}}-R]_yNG_2$$

wherein R, B, w, x, and y are the same as defined herein above and G is hydrogen or an extension of the PA unit backbone by grafting. Non-limiting examples of preferred grafting agents are aziridine (ethyleneimine), caprolactam, and mixtures thereof. A preferred grafting agent is aziridine wherein the backbone is extended by units having the formula:

$$-[CH_2CH_2NH]_p[CH_2CH_2\overset{B'}{\overset{|}{N}}]_qCH_2CH_2NH_2$$

wherein B' is a continuation by branching wherein the graft does not exceed about 12 units, preferably $—CH_2CH_2NH_2$ and the value of the indices p+q have the value from 0, preferably from about 1, more preferably from about 2 to about 7, preferably to about 5. Another preferred grafting unit is caprolactam.

The PA units of the present invention can be grafted prior to or after crosslinking with one or more T units described herein below, preferably the grafting is accomplished after crosslinking with said T unit. This allows the formulator to take advantage of the differential reactivity between the primary and secondary amino units of the PA unit backbone thereby allowing the formulator to controllably link said PA units and to also control the amount of subsequent branching which results from the grafting step.

Another optional but preferred PA unit modification is the presence of "capping" units. For example, a PA unit is reacted with an amount of a monocarboxylic acid, non-limiting examples of which are $C_1$–$C_{22}$ linear or branched alkyl, preferably $C_{10}$–$C_{18}$ linear alkyl inter alia lauric acid, myristic acid. The amount of capping unit which is reacted with the PA unit is an amount which is sufficient to achieve the desired properties of the formula. However, the amount of capping unit used is not sufficient to abate any further crosslinking or grafting which the formulator may choose to perform.

Crosslinking Units

Amide-forming T Crosslinking Units

T crosslinking units are preferably carbonyl comprising polyamido forming units. The T units are taken together with PA units to form crosslinked modified polyamine compounds having the formula $(PA)_w(T)_x$ or $[(PA)_w(T)_x]_y[L]_z$.

A preferred embodiment of the present invention includes crosslinked PA units wherein a T unit provides crosslinking between two or more PA units to form a $(PA)_w(T)_x$ polyamido crosslinked section. A preferred crosslinking T unit has the general formula:

$$-\overset{O}{\overset{\|}{C}}-(R^2)_j-(R^1)_k-(R^2)_j-\overset{O}{\overset{\|}{C}}-$$

wherein $R^1$ is methylene, phenylene, and mixtures thereof; preferably methylene. The index k has the value from 2 to about 8, preferably to about 4. Preferred values of k are 2, 3, and 4. $R^2$ is —NH— thereby forming a urethane amide linkage when said $R^2$ comprising T units react with the backbone nitrogens of the PA units. The value of the index j is independently 0 or 1. The presence of $R^2$ units can result, for example, from the use of diisocyanates as crosslinking agents. Non-limiting examples of dibasic acids which are used as a source for T units in the above formula include succinic acid, maleic acid, adipic acid, glutaric acid, suberic acid, sebacic acid, and terephthalic acid. However, the formulator is not limited to crosslinking T units deriving from dibasic acids, for example, tribasic crosslinking T units, inter alia, citrate, may be used to link the PA units of the present invention.

Examples of $(PA)_w(T)_x$ compounds according to the present invention are obtained by condensation of dicarboxylic acids inter alia succinic acid, maleic acid, adipic acid, terephthalic acid, with polyalkylene polyamines inter alia diethylenetriamine, triethylenetetranine, dipropylenetriamine, tripropylenetetramine wherein the ratio of the dicarboxylic acid to polyalkyleneimine is from 1:0.8 to 1:1.5 moles, preferably a ratio of from 1:0.9 to 1:1.2 moles wherein the resulting crosslinked material has a viscosity in a 50% by weight, aqueous solution of more than 100 centipoise at 25° C.

Non-amide Forming L Crosslinking Units

Another preferred embodiment of the polyamines of the present invention are $(PA)_w(T)_x$ units which are further crosslinked by L units to form polyamido amines having the formula $[(PA)_w(T)_x]_y[L]_2$ or are reacted with PA units to form non-amide polyamines having the formula $(PA)_w(L)_z$.

The L units of the present invention are any unit which suitably crosslinks PA units or $(PA)_w(T)_x$ units. Preferred L linking units comprise units which are derived from the use of epihalohydrins, preferably epichlorohydrin, as a crosslinking agent. The epihalohydrins can be used directly with the PA units or suitably combined with other crosslinking adjuncts non-limiting examples of which include alkyleneglycols, and polyalkylene polyglycols inter alia ethylene glycol, diethylene glycol, polyethylene glycol, propylene glycol, dipropylene glycol, polypropylene glycol, butylene glycol, hexanediol-1,6-glycerol, oligoglycerol, pentaerythrites, polyols which are obtained by the reduction of carbohydrates (sorbitol, mannitol), monosaccharides, disaccharides, oligosaccharides, polysaccharides, polyvinyl alcohols, and mixtures thereof.

For example, a suitable L unit is a dodecylene unit having the formula:

$$-(CH_2)_{12}-$$

wherein an equivalent of 1,12-dichlorododecane is reacted, for example, with a suitable amount of a PA unit to produce a polyamine which is crosslinked via dodecylene units. For the purposes of the present invention, L crosslinking units which comprise only carbon and hydrogen are considered to be "hydrocarbyl" L units. Preferred hydrocarbyl units are polyalkylene units have the formula:

$$-(CH_2)_n-$$

wherein n is from 1 to about 50.

Hydrocarbyl L units may be derived from hydrocarbons having two units which are capable of reacting with the nitrogen of the PA units. Non-limiting examples of precursors which result in the formation of hydrocarbyl L units include 1,6-dibromohexane, 1,8-ditosyloctane, and 1,14-dichlorotetradecane.

Further examples of preferred non-amide forming crosslinking L units are the units which derive from crosslinking units wherein epihalohydrin is used as the connecting unit. For example, 1,12-dihydroxydodecane is reacted with epichlorohydrin to form the bis-epoxide non-amide forming L unit precursor having the formula:

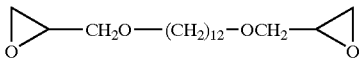

which when reacted with one or more PA units or $(PA)_w(T)_x$ units results in an L crosslinking unit having the formula:

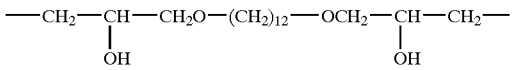

however, it is not necessary to pre-form and isolate the bis-epoxide, instead the crosslinking unit precursor may be formed in situ by reaction of 1,12-dihydroxydodecane or other suitable precursor unit with epihalohydrin in the presence of grafted or ungrafted PA units or $(PA)_w(T)_x$ units.

Other crosslinking L units which utilize one or more epihalohydrin connecting units include polyalkyleneoxy L units having the formula:

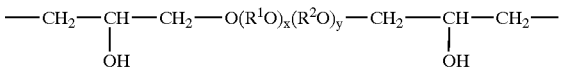

wherein $R^1$ is ethylene, $R^2$ is 1,2-propylene, x is from 0 to 100 and y is from 0 to 100. Another preferred unit which can comprise an L unit and which can be suitably combined with epihalohydrin connecting units include polyhydroxy units having the formula:

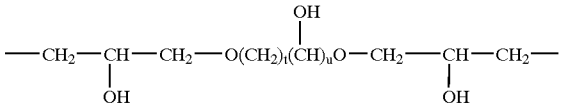

wherein the index t is from at least 2 to about 20 and the index u is from 1 to about 6. The formulator may also combine units to form hybrid L crosslinking units, for example, units having the formula:

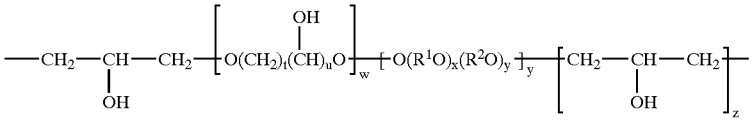

wherein the indexes w and y are each independently from 1 to 50, z is units are present in a sufficient to suitably connect the polyhydroxy units and the polyalkyleneoxy units into the backbone without the formation of ether linkages.

The following is an example of an L linkidng group which comprises both a polyalkyleneoxy and a polyhydroxy unit.

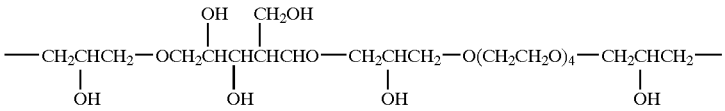

A further example of a preferred crosslinking L units are units which comprises at least two aziridine groups as connecting groups, for example an L unit having the formula:

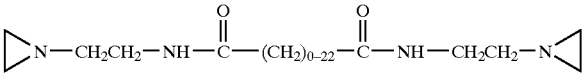

which can be used to link two $(PA)_w$ units, two $(PA)_w(T)_x$ units, or mixtures thereof.

The polyamines of the present invention may have varying final compositions, for example, $(PA)_w(T)_x$, $[(PA)_w(T)_x]_y[L]_z$, $[(PA)]_w[L]_z$, and mixtures thereof, wherein each PA unit may be grafted or ungrafted. The indices w and x have values such that the ratio of w to x is from 0.8:1 to 1.5:1; y and z have values such that said polyamido compound comprises from about 0.05, preferably to about 0.3 to 2 parts by weight of said L unit. In the cases wherein no crosslinking takes place the indices w and y will be equal to 1 and x and z will be equal to 0. In the case wherein no crosslinking occurs using L units, the index y is equal to 1 and z is equal to 0. In the case wherein no crosslinking occurs using T units, the indices w and y are equal to 1 and x is equal to 0.

An preferred embodiment of the present invention which comprises PA units, T units, and L units includes the reaction product of:

a) 1 part by weight, of a polyamine obtained by condensation of 1 mole of a dicarboxylic acid with a polyalkylene polyamine (i.e., diethylenetriamine) to the extent wherein at least about 10% of the —NH backbone hydrogens are unmodified by reaction with said dicarboxylic acid, then optionally reacting the obtained polyamine condensation product with up to 12 ethyleneimine units (i.e., grafting of the backbone using aziridine) per basic nitrogen atom; and b) further reacting the product obtained in (a) with from 0.05, preferably from about 0.3 to about 2 parts by weight, of an L units, inter alia the reaction product of a polyalkylene oxide having from 8 to 100 alkylene oxide units with epichlorohydrin at a temperature of form about 20° C. to about 100° C.

A preferred embodiment of the present invention are the water-soluble condensation products which can be obtained by the reaction of a) polyalkyleneimines and polyalkyleneimines grafted with ethyleneimines, and mixtures thereof; with b) at least bifunctional halogen-free cross-linking agents, said agents selected from the group consisting of:

i) ethylene carbonate, propylene carbonate, urea, and mixtures thereof;

ii) mono-carboxylic acids comprising one olefin moiety inter alia acrylic acid, methacrylic acid, crotonic acid; and the esters, amides, and anhydrides thereof; polycarboxylic acids inter alia oxalic acid, succinic acid, tartaric acid, itaconic acid, maleic acid; and the esters, amides, and anhydrides thereof;

iii) reaction products of polyetherdiamines, alkylenediamines, polyalkylene-diamines, and mixtures thereof, with mono-carboxylic acids comprising one olefin moiety wherein the resulting polyamine comprises a functional units which is selected from the group consisting of at least two ethylenically unsaturated double bonds, carbonamide, carboxyl group, ester group, and mixtures thereof;

iv) at least two aziridine group-containing reaction products of dicarboxylic acid esters with ethyleneimine and mixtures of the cross-linking agents.

However, prior to reaction of $(PA)_w(T)_x$ units formed herein above, the $(PA)_w(T)_x$ polyamine compound may be partially amidated ("capped" as described herein above) by treatment with a mono carboxylic acid or the esters of mono carboxylic acids. The formulator may vary the degree to which the backbone nitrogens are amidated according to the desired properties of the final Fabric Enhancement Polymer. Non-limiting examples of suitable mono-carboxylic acids include formic acid, acetic acid, propionic acid, benzoic acid, salicylic acid, lauric acid, palmitic acid, stearic acid, oleic acid, linoleic acid, behenic acid, and mixtures thereof.

The high molecular weight modified polyamine condensation products of the present invention (also referred to herein as "resins") are preferably formed from the reaction of one or more grafted, cross-linked polyethyleneimines and one or more polyethylene and/or polypropylene glycol copolymers, wherein the resulting crosslinked modified polyamines (resins) have a final viscosity of more than or equal to 300 mPa-sec., preferably from 400 to 2,500 mPa-sec. when measured at 20° C. in a 20% aqueous solution. The modified polyamine compounds of the present invention are suitably described in U.S. Pat. No. 3,642,572 Eadres et al., issued Feb. 15, 1972, U.S. Pat. No. 4,144,123 Scharf et al., issued Mar. 13, 1979 and U.S. Pat. No. 4,371,674 Hertel et al., issued Feb. 1, 1983, NE 6,612,293, DT 1,946,471, DT 36386, DT 733,973, DE 1,771,814, all of which are included herein by reference.

3. Amino Acid-Based Polyamines

A further example of preferred polyamines according to the present invention are polyamines derived from amino acid residues. For the purposes of the present invention the term "residue" is defined as "one unit which comprises the polymeric material of the present invention". A non-limiting example of a residue which comprises the polymeric material is a lysine residue having the formula:

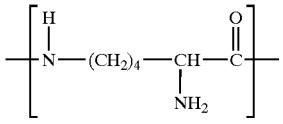

wherein preferably said lysine residue forms the backbone of said polymeric material by forming a bond to the ω-amino unit, however, the lysine residue may be suitably incorporated into the backbone via the α-amino unit; or an ornithine residue having the formula:

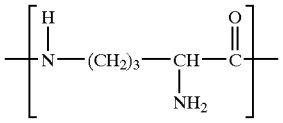

wherein preferably said ornithine residue forms the backbone of said polymeric material by forming a bond to the ω-amino unit, however, the ornithine residue may be optionally incorporated into the backbone via the α-amino unit; and said lysine residue or ornithine residue may have any optical isomer form, i.e., dextrorotatory, levorotatory.

The amino acid-based polymers of the present invention comprise at least about 5% by weight of lysine, ornithine, or mixtures thereof, preferably at least about 10%, more preferably at least about 20%, most preferably at least about 40% by weight of lysine, ornithine, or mixtures thereof.

For the purposes of the present invention the terms "N-term" and "C-term" are defined as an "amino terminating unit" and a "carboxyl terminating unit" respectively and are used throughout the present specification to indicate the capping units of the main polymeric chain as well as any branching chains.

The polymeric material of the present invention has the formula:

$$\text{N-term}—[\text{Lys}]_x—[\text{Orn}]_y—[\text{AA}]_z—\text{C-term}$$

wherein Lys represents a residue of the amino acid lysine, Orn represents a residue of the amino acid ornithine, and AA represents a residue of a non-lysine or non-ornithine amino acid, carboxylic acid, or other chain propagating residue.

In general, the lysine and ornithine residues are preferably incorporated into the polymeric chain via the ω-amino residue and the carboxylate residue. However, this "normal" incorporation does not preclude incorporation of a lysine or ornithine residue into the backbone or branch chain via two amino units whereby the carboxyl unit remains un-incorporated into any chain.

AA units are amino acid or other chain propagating residues having the formula:

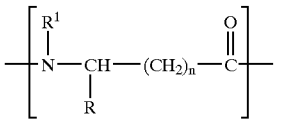

wherein the index n is from 0 to 10, preferably 1, 2 and 4; the preferred R units are independently selected from the group consisting of:

i) hydrogen;

ii) $—(CH_2)_mCOR^2$ wherein:

$R^2$ is —OH, for example wherein said amino acid, AA residue is glutamic acid, aspartic acid, etc.;

$R^2$ is an amino lactam C-terminal capping group, preferably a unit having the formula:

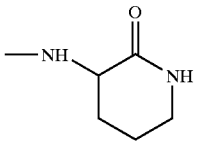

-continued
or the formula:

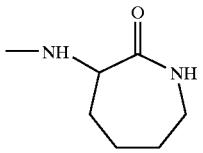

$R^2$ is an N-terminal residue of a cross-linking chain comprising one or more residues which provides cross-linking between two polymeric material chains, for example, $R^2$ may comprise one end of a diamine inter alia hexamethylene diamine, an N-terminal residue which links the main polymeric chain to a branched chain, for example, a branched chain having the general formula:

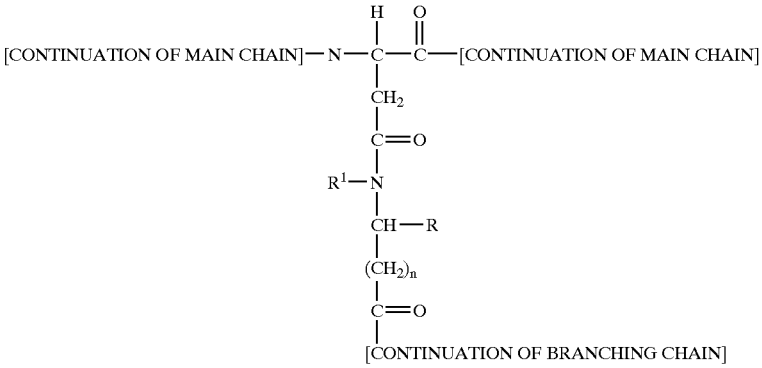

preferably, when $R^2$ is an amide-forming unit, $R^2$ is derived from the reaction of the lysine/ornithine polymeric material with caprolactam, amino caproic acid, and mixtures thereof; the index m is from 0 to 3, preferably the index m is 1 or 2, more preferably 1;

iii) benzyl;

iv) 4-hydroxybenzyl;

v) 3-(guanidinyl)propyl;

vi) (1H-indol-3-yl)methyl;

vii) (1H-imidazol-5-yl)methyl;

viii) is mixtures thereof.

$R^1$ units are independently selected form the group consisting of:

i) hydrogen; preferred unit;

ii) the C terminal end of a cross-linking chain comprising one or more residues which provides either cross-linking between two polymeric material chains or a branching of the polymer chain, preferably when $R^1$ is a C terminal unit, said unit is derived from the reaction of the lysine/ornithine polymeric material with caprolactam, amino caproic acid, and mixtures thereof;

iii) $C_1$–$C_{18}$ linear or branched alkyl, preferably methyl;

iv) $C_2$–$C_{18}$ linear or branched alkenyl;

v) $C_2$–$C_{18}$ linear or branched hydroxyalkyl;

vi) $C_3$–$C_8$ cycloalkyl;

vii) aryl;

viii) $C_6$–$C_{18}$ substituted or unsubstituted alkylenearyl, preferably benzyl;

ix) one end of a di-carboxylic acid linking group wherein two polymeric chains are linked by reaction of the lysine/ornithine polymeric material with a di-carboxylic acid or di-carboxylic acid ester; and x) mixtures thereof.

Non-limiting examples of preferred AA amino acid residues are arginine, tryptophan, tyrosine, histidine, aspartic acid, glutamic acid, asparagine, glutamine, serine, threonine, and mixtures thereof. More preferred AA amino acid residues are selected form the group consisting of arginine, tryptophan, and mixtures thereof.

N-term amino terminal capping groups terminate, truncate or end the amine terminus of the main polymeric chain or branch chains. Preferred amino terminal capping groups are selected from the group consisting of:

i) hydrogen (most preferred);

ii) $C_1$–$C_{18}$ linear or branched alkyl, preferably methyl;

iii) $C_2$–$C_{18}$ linear or branched alkenyl;

iv) $C_3$–$C_8$ cycloalkyl;

v) aryl;

vi) $C_6$–$C_{18}$ substituted or unsubstituted alkylenearyl, preferably benzyl;

vii) $C_1$–$C_{18}$ linear or branched acyl, preferably the N-terminal units of the polymer are capped (partially amidated) with an acyl unit inter alia lauric acid, myristic acid, behenic acid;

viii) $C_2$–$C_{22}$ diacyl units, for example units derived from dicarboxylic acids or esters thereof, which can serve to cap two separate N-terminal units at the same time: and ix) mixtures thereof.

C-term carboxy terminal capping groups terminate, truncate, or end the carboxy terminus of the main polymeric chain or branch chains. Preferred carboxy terminal capping groups are selected from the group consisting of:

i) —OM wherein M is hydrogen or a salt forming cation, most preferred capping unit is —OH;

ii) —$N(R^3)_2$ wherein each $R^3$ is independently $C_1$–$C_{18}$ linear or branched alkyl; $C_2$–$C_{18}$ linear or branched hydroxyalkyl, $C_3$–$C_8$ cycloalkyl, and mixtures thereof, preferably methyl;

iii) preferably an amino lactam unit having the formula:

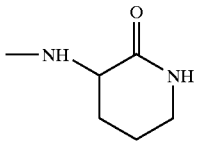

iv) preferably an amino lactam unit having the formula:

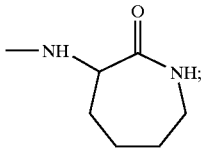

v) units having an amine function, including:

a) mono amines having the formula:

$R^1R^2NH$ wherein $R^1$ and $R^2$ are each independently hydrogen or a hydrocarbyl unit comprising from 1 to 22 carbon atoms;

b) polyamines having the formula:

$[H_2N—R][\overset{H}{\overset{|}{N}}—R]_mNH_2$ wherein R is $C_2$–$C_{22}$ alkylene, m is from 0 to about 5; e.g. ethylene diamine, hexamethylenediamine;

c) preferably the C terminal end of the lysine/ornithine polymeric materials are truncated by reacting said polymeric materials with one or more equivalents of caprolactam and/or amino caproic acid; and vi) mixtures thereof.

The polyamines which serve as carbonyl end units may serve to cap one or more carboxy terminal units of the same chain or two or more different chains. The preferred polymer chains of the present invention have the amino terminus (N-term unit) of the main chain and branch chains capped with hydrogen and the carboxy terminus (C-term unit) of the main chain and branch chains capped with —OH.

As described herein above, the formulator may, preferably partially amidate the compounds of the present invention by treatment with a mono carboxylic acid or the esters of mono carboxylic acids. The formulator may vary the degree to which the backbone nitrogens are amidated according to the desired properties of the final Fabric Enhancement Polymer. Non-limiting examples of suitable mono-carboxylic acids include formic acid, acetic acid, propionic acid, benzoic acid, salicylic acid, lauric acid, palmitic acid, stearic acid, oleic acid, linoleic acid, behenic acid, and mixtures thereof.

In a preferred embodiment of the present invention an amino acid having two amine moieties inter alia lysine, ornithine is co-condensed with caprolactam or aminocaproic acid to form a co-condensation product. Other preferred co-condensates include reaction of lysine or ornithine with lauric acid to form the amidated polymer.

The amino units of any lysine, ornithine, or AA unit may be optionally quaternized, preferably quaternized by one or more units selected from the group consisting of $C_1$–$C_4$ linear or branched alkyl, benzyl, and mixtures thereof.

In addition, N-terminal or C-terminal capping units which have more than one functionality inter alia two carboxy units of a diacid (succinic acid), may crosslink two or more poly lysine or poly ornithine comprising chains. Therefore, in addition to capping, and therefore truncating the N-terminal ends of two separate polyamine backbones, a unit such as succinic acid may crosslink two polyamine chains.

The molecular weight of the amino acid-based polymeric materials of the present invention are preferably from about 400 daltons, more preferably from about 1000 daltons, most preferably from about 2000 daltons to preferably about 500,000 daltons, more preferably to about 25,000 daltons, most preferably to about 10,000 daltons.

3. Tethered Polymeric Amines

Another suitable class of polyamines of the present invention are the polyamines wherein the amine nitrogen is tethered to an alkylene backbone. The following are non-limiting examples of tethered polymeric amines according to the present invention.

The tethered polymeric amines of the present invention have the general formula:

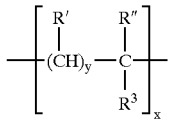

wherein R' and R" are each independently hydrogen, $C_1$–$C_6$ alkyl, phenyl, substituted phenyl, $C_7$–$C_{22}$ alkylenearyl, and mixtures thereof, $R^3$ is an amine comprising unit, non-limiting examples of which include: $—N(R)_2$, $—N^+(R)_3$, $—C(O)N(R)_2$, $—C(O)N^+(R)_3$, and mixtures thereof; wherein R is hydrogen, $C_1$–$C_{12}$ linear or branched alkyl, benzyl, or alkyleneoxy having the formula $(R^1O)_zY$, wherein $R^1$ is $C_1$–$C_6$ linear or branched alkylene, Y is hydrogen or an anionic unit. Each caution nitrogen will have an anionic unit X which provides charge neutrality to the polymer. The index x is from about 5 to about 1,000,000 (one million) depending upon the properties which the formulator may wish to provide via the tethered polyamine.

Polyvinylamine Polymers

One class of tethered polymeric amines are the quaternized and non-quaternized polyvinylamines having the formula:

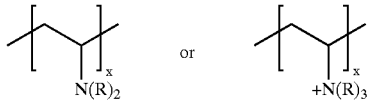

wherein R is hydrogen, $C_1$–$C_{12}$ linear or branched alkyl, benzyl, or alkyleneoxy having the formula $(R^1O)_zY$, wherein $R^1$ is $C_1$–$C_6$ linear or branched alkylene, Y is hydrogen or an anionic unit, non-limiting examples of which include, $—(CH_2)_fCO_2M$, $—C(O)(CH_2)_fCO_2M$, $—(CH_2)_fPO_3M$, $—(CH_2)_fOPO_3M$, $—(CH_2)_fSO_3M$, $—CH_2(CHSO_3M)—(CH_2)_fSO_3M$, $—CH_2(CHSO_2M)(CH_2)_fSO_3M$, $—C(O)CH_2CH(SO_3M)CO_2M$, $—C(O)CH_2CH(CO_2M)NHCH(CO_2M)CH_2CO_2M$, $—C(O)CH_2CH(CO_2M)NHCH_2CO_2M$, $—CH_2CH(OZ)CH_2O(R^1O)_tZ$, $—(CH_2)_fCH[O(R^2O)_tZ]CH_2O(R^2O)_tZ$, and mixtures thereof, wherein Z is hydrogen or an anionic unit non-limiting examples of which include $—(CH_2)_fCO_2M$, $—C(O)(CH_2)_fCO_2M$, $—(CH_2)_fPO_3M$, $—(CH_2)_fOPO_3M$, $—(CH_2)_fSO_3M$, $—CH_2(CHSO_3M)—(CH_2)_fSO_3M$, $—CH_2(CHSO_2M)(CH_2)_fSO_3M$, —C(O)

$CH_2CH(SO_3M)CO_2M$, —$C(O)CH_2CH(CO_2M)NHCH(CO_2M)CH_2CO_2M$, and mixtures thereof, M is a cation which provides charge neutrality; and the index f is from 0 to 6, t is 0 or 1, z is from 1 to 50.

The index x has the value from about 50 to about 1,500; preferably the index x has a value such that the resulting polymeric suds stabilizer has an average molecular weight of from about 2,500, preferably from about 10,000, more preferably from about 20,000 to about 150,000, preferably to about 90,000, more preferably to about 80,000 daltons.

Acrylamide Polymers

One class of polymeric suds stabilizer according to the present invention are the alkyl acrylamides having the formula:

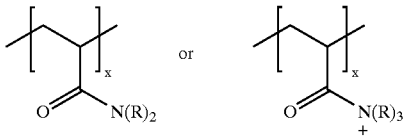

wherein R is hydrogen, $C_1$–$C_{12}$ linear or branched alkyl, benzyl, or alkyleneoxy having the formula $(R^1O)_zY$, wherein $R^1$ is $C_1$–$C_6$ linear or branched alkylene, Y is hydrogen or an anionic unit, non-limiting examples of which include, —$(CH_2)_fCO_2M$, —$C(O)(CH_2)_fCO_2M$, —$(CH_2)_fPO_3M$, —$(CH_2)_fOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, —$C(O)CH_2CH(CO_2M)NHCH_2CO_2M$, —$CH_2CH(OZ)CH_2O(R^1O)_tZ$, —$(CH_2)_fCH[O(R^2O)_tZ]CH_2O(R^2O)_tZ$, and mixtures thereof, wherein Z is hydrogen or an anionic unit non-limiting examples of which include —$(CH_2)_fCO_2M$, —$(O)(CH_2)_fCO_2M$, —$CH_2)_fPO_3M$, —$(CH_2)_fOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, and mixtures thereof, M is a cation which provides charge neutrality; and the index f is from 0 to 6, t is 0 or 1, z is from 1 to 50.

The index x has the value from about 50 to about 1,500; preferably the index x has a value such that the resulting polymer has an average molecular weight of from about 2,500, preferably from about 10,000, more preferably from about 20,000 to about 150,000, preferably to about 90,000, more preferably to about 80,000 daltons.

EXAMPLE 1

Preparation of PEI 600 $E_{20}$

The ethoxylation is conducted in a 2 gallon stirred stainless steel autoclave equipped for temperature measurement and control, pressure measurement, vacuum and inert gas purging, sampling, and for introduction of ethylene oxide as a liquid. A~20 lb. net cylinder of ethylene oxide (ARC) is set up to deliver ethylene oxide as a liquid by a pump to the autoclave with the cylinder placed on a scale so that the weight change of the cylinder could be monitored.

A 250 g portion of polyethyleneimine (PEI) (Nippon Shokubai, having a listed average molecular weight of 600 equating to about 0.417 moles of polymer and 6.25 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 275 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 135 g of a 25% sodium methoxide in methanol solution (0.625 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of approximately 5225 g of ethylene oxide (resulting in a total of 20 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 60 g methanesulfonic acid (0.625 moles). The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

EXAMPLE 2

4.7% Oxidation of 9.5% Quaternized PEI 1200 E7

The ethoxylation is conducted in a 2 gallon stirred stainless steel autoclave equipped for temperature measurement and control, pressure measurement, vacuum and inert gas purging, sampling, and for introduction of ethylene oxide as a liquid. A~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneamine (PEI) (having a listed average molecular weight of 1200 equating to about 0.625 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour.

To a 500 ml erlenmeyer flask equipped with a magnetic stirring bar is added poly(ethyleneimine), MW 1200 ethoxylated to a degree of 7 (248.4 g, 0.707 mol nitrogen, prepared as above) and acetonitrile (Baker, 200 mL). Dimethyl sulfate (Aldrich, 8.48 g, 0.067 mol) is added all at once to the rapidly stirring solution, which is then stoppered and stirred at room temperature overnight. The acetonitrile is evaporated on the rotary evaporator at ~60° C., followed by a Kugelrohr apparatus (Aldrich) at ~80° C. to afford ~220 g of the desired material as a dark brown viscous liquid. A $^{13}$C-NMR ($D_2O$) spectrum shows the absence of a peak at ~58 ppm corresponding to dimethyl sulfate. A $^{1}$H-NMR ($D_2O$) spectrum shows the partial shifting of the peak at 2.5 ppm (methylenes attached to unquaternized nitrogens) to ~30 ppm.

To a 500 ml erlenmeyer flask equipped with a magnetic stirring bar is added poly(ethyleneimine), MW 1200 which has been ethoxylated to a degree of 7, and ~9.5% quaternized with dimethyl sulfate (144 g, ~0.37 mol oxidizeable nitrogen, prepared as above), hydrogen peroxide (Aldrich, 35.4 g of a 50 wt % solution in water, 0.52 mol), and water (100 g). The flask is stoppered, and after an initial exotherm the solution is stirred at room temperature overnight. A $^{1}$H-NMR ($D_2O$) spectrum shows the total shifting of the methylene peaks at 2.5–30 ppm to ~3.5 ppm. To the solution is added just enough sodium bisulfite as a 40% water solution to bring the residual peroxide level down to 1–5 ppm. The sodium sulfate which forms causes an aqueous phase to separate which contains salts, but little or no organics. The aqueous salt phase is removed and the desired oxidized polyethyleneimine derivative is obtained and stored as a 52% solution in water.

EXAMPLE 3

Preparation of 4,9-dioxa-1,12-Dodecanediamine, Ethoxylated to Average E20 per NH, Quaternized to 90%, and Sulfated to 90%

1. Ethoxylation of 4,9-dioxa-1,12-dodecanediamine to an average of 20 ethoxylations per backbone NH unit: The ethoxylation is conducted in a 2 gallon stirred stainless steel autoclave equipped for temperature measurement and control, pressure measurement, vacuum and inert gas purging, sampling, and for introduction of ethylene oxide as a liquid. A~20 lb. net cylinder of ethylene oxide is set up to deliver ethylene oxide as a liquid by a pump to the autoclave with the cylinder placed on a scale so that the weight change of the cylinder can be monitored. A 200 g portion of 4,9-dioxa-1,12-dodecanediamine ("DODD", m.w. 204.32, 97%, 0.95 moles, 1.9 moles N, 3.8 moles ethoxylatable NH's) is added to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 167 grams of ethylene oxide (3.8 moles) has been charged to the autoclave, the temperature is increased to 110° C. and the autoclave is allowed to stir for an additional 2 hours. At this point, vacuum is applied to remove any residual unreacted ethylene oxide.

Vacuum is continuously applied while the autoclave is cooled to about 50° C. while introducing 41 g of a 25% sodium methoxide in methanol solution (0.19 moles, to achieve a 10% catalyst loading based upon DODD nitrogen functions). The methanol from the methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm After the addition of 3177 g of ethylene oxide (72.2 mol, resulting in a total of 20 moles of ethylene oxide per mole of ethoxylatable sites on DODD), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 18.2 g methanesulfonic acid (0.19 moles) with heating (100° C.) and mechanical stirring. The reaction mixture is then purged of residual ethylene oxide and deodorized by sparging an inert gas (argon or nitrogen) into the mixture through a gas dispersion frit while agitating and heating the mixture to 120° C. for 1 hour. The final reaction product is cooled slightly and transferred to a glass container purged with nitrogen for storage.

2. Quaternization of 4,9-dioxa-1,12-dodecanediamine which is ethoxylated to an average of 20 ethoxylations per backbone NH unit: Into a weighed, 2000 ml, 3 neck round bottom flask fitted with argon inlet, condenser, addition funnel, thermometer, mechanical stirring and argon outlet (connected to a bubbler) is added DODD EO20 (561.2 g, 0.295 mol N, 98% active, m.w.-3724) and methylene chloride (1000 g) under argon. The mixture is stirred at room temperature until the polymer has dissolved. The mixture is then cooled to 5° C. using an ice bath. Dimethyl sulfate (39.5 g, 0.3lmol, 99%, m.w.-126.13) is slowly added using an addition funnel over a period of 15 minutes. The ice bath is removed and the reaction is allowed to rise to room temperature. After 48 hrs. the reaction is complete.

3. Sulfation of 4,9-dioxa-1,12-dodecanediamine which is quaternized to about 90% of the backbone nitrogens of the product admixture and which is ethoxylated to an average of 20 ethoxylations per backbone NH unit: Under argon, the reaction mixture from the quaternization step is cooled to 5° C. using an ice bath (DODD EO20, 90+mol % quat, 0.59 mol OH). Chlorosulfonic acid (72 g, 0.61 mol, 99%, mw-116.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (264 g, 1.22 mol, Aldrich, 25% in methanol, m.w.-54.02) is slowly added to the rapidly stirred mixture. The temperature of the reaction mixture is not allowed to rise above 10° C. The reaction mixture is transferred to a single neck round bottom flask. Purified water (1300 ml) is added to the reaction mixture and the methylene chloride, methanol and some water is stripped off on a rotary evaporator at 50° C. The clear, light yellow solution is transferred to a bottle for storage. The final product pH is checked and adjusted to ~9 using 1N NaOH or 1N HCl as needed. Final weight ~1753 g.

EXAMPLE 4

Preparation of bis(Hexamethylene)triamine, Ethoxylated to Average E20 per NH, Quaternized to 90%, and Sulfated to 35%

1. Ethoxylation of bis(hexamethylene)triamine: The ethoxylation is conducted in a 2 gallon stirred stainless steel autoclave equipped for temperature measurement and control, pressure measurement, vacuum and inert gas purging, sampling, and for introduction of ethylene oxide as a liquid. A~20 lb. net cylinder of ethylene oxide is set up to deliver ethylene oxide as a liquid by a pump to the autoclave with the cylinder placed on a scale so that the weight change of the cylinder could be monitored.

A 200 g portion of bis(hexamethylene)triamine (BHMT) (M.W. 215.39, high purity 0.93 moles, 2.8 moles N, 4.65 moles ethoxylatable (NH) sites) is added to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned on and off and cooling is applied to limit any temperature increase resulting from any reaction exotherm. The temperature is maintained between 100 and 110° C. while the total pressure is allowed to gradually increase during the course of the reaction. After a total of 205 grams of ethylene oxide (4.65 moles) has been charged to the autoclave, the temperature is increased to 110° C. and the autoclave is allowed to stir for an additional 2 hours. At this point, vacuum is applied to remove any residual unreacted ethylene oxide.

Vacuum is continuously applied while the autoclave is cooled to about 50° C. while introducing 60.5 g of a 25% sodium methoxide in methanol solution (0.28 moles, to achieve a 10% catalyst loading based upon BHMT nitrogen functions). The methanol from the methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 3887 g of ethylene oxide (88.4 mol, resulting in a total of 20 moles of ethylene oxide per mol of ethoxylatable sites on BHMT), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 27.2 g methanesulfonic acid (0.28 moles) with heating (100° C.) and mechanical stirring. The reaction mixture is then purged of residual ethylene oxide and deodorized by sparging an inert gas (argon or nitrogen) into the mixture through a gas dispersion frit while agitating and heating the mixture to 120° C. for 1 hour. The final reaction product is cooled slightly, and poured into a glass container purged with nitrogen for storage.

2. Quaternization of bis(hexamethylene)triamine which is ethoxylated to an average of 20 ethoxylations per backbone NH unit: Into a weighed, 500 ml, 3 neck round bottom flask fitted with argon inlet, condenser, addition funnel, thermometer, mechanical stirring and argon outlet (connected to a bubbler) is added BHMT EO20 (150 g, 0.032 mol, 0.096 mol N, 98% active, m.w.-4615) and methylene chloride (300 g) under argon. The mixture is stirred at room temperature until the polymer has dissolved. The mixture is then cooled to 5° C. using an ice bath. Dimethyl sulfate (12.8 g, 0.1 mol, 99%, m.w.-126.13) is slowly added using an addition funnel over a period of 5 minutes. The ice bath is removed and the reaction is allowed to rise to room temperature. After 48 hrs. the reaction is complete.

3. Sulfation of bis(hexamethylene)triamine which is quaternized to about 90% of the backbone nitrogens of the product admixture and which is ethoxylated to an average of 20 ethoxylations per backbone NH unit: Under argon, the reaction mixture from the quaternization step is cooled to 5° C. using an ice bath (BHMT EO20, 90+mol % quat, 0.16 mol OH). Chlorosulfonic acid (7.53 g, 0.064 mol, 99%, mw-116.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (28.1 g, 0.13 mol, Aldrich, 25% in methanol, m.w.-54.02) is slowly added to the rapidly stirred mixture. The temperature of the reaction mixture is not allowed to rise above 10° C. The reaction mixture is transferred to a single neck round bottom flask. Purified water (500 ml) is added to the reaction mixture and the methylene chloride, methanol and some water is stripped off on a rotary evaporator at 50° C. The clear, light yellow solution is transferred to a bottle for storage. The final product pH is checked and adjusted to ~9 using 1N NaOH or 1N HCl as needed. Final weight, 530 g.

SURFACTANT SYSTEM

The laundry detergent compositions of the present invention comprise a surfactant system. A required component of the surfactant system is one or more mid-chain branched alkyl sulfate surfactant, one or more mid-chain branched alkyl alkoxy sulfate surfactant, or one or more mid-chain branched aryl sulfonate surfactant. Other anionic surfactants, inter alia, non mid-chain branched sulphonates, sulphates, together with nonionic surfactants, caution surfactants, surfactants, and ampholytic surfactants may comprise the balance of the surfactant system. The total amount of surfactant present in the compositions is from about 0.01% by weight, preferably from about 0.1% more preferably from about 1% to about 60%, preferably to about 30% by weight, of said composition.

Mid-chain Branched Alkyl Sulfates

The surfactant systems of the present invention may comprise a mid-chain branched alkyl sulfate surfactant and/or a mid-chain branched alkyl alkoxy sulfate surfactant. Because mid-chain branched alkyl sulfate or alkyl alkoxy sulfate surfactants are not required when mid-chain branched aryl sulfonate surfactants are present, the surfactant system comprises from 0%, when present from 0.01%, preferably from about 0.1% more preferably from about 1% to about 100%, preferably to about 80% by weight, preferably to about 60%, most preferably to about 30% by weight, of the surfactant system. When the mid-chain branched alkyl sulfate surfactants or mid-chain branched alkyl alkoxy sulfate surfactants comprise 100% of the surfactant system said surfactants will comprise up to 60% by weight of the final laundry detergent composition.

The mid-chain branched alkyl sulfate surfactants of the present invention have the formula:

$$CH_3CH_2(CH_2)_wCH(R)(CH_2)_xCH(R^1)(CH_2)_yCH(R^2)(CH_2)_zOSO_3M,$$

the alkyl alkoxy sulfates have the formula:

$$CH_3CH_2(CH_2)_wCH(R)(CH_2)_xCH(R^1)(CH_2)_yCH(R^2)(CH_2)_z(OR^3)_mOSO_3M,$$

wherein R, $R^1$, and $R^2$ are each independently hydrogen, $C_1$–$C_3$ alkyl, and mixtures thereof; provided at least one of R, $R^1$, and $R^2$ is not hydrogen; preferably R, $R^1$, and $R^2$ are methyl; preferably one of R, $R^1$, and $R^2$ is methyl and the other units are hydrogen. The total number of carbon atoms in the mid-chain branched alkyl sulfate and alkyl alkoxy sulfate surfactants is from 14 to 20; the index w is an integer from 0 to 13; x is an integer from 0 to 13; y is an integer from 0 to 13; z is an integer of at least 1; provided w+x+y+z is from 8 to 14 and the total number of carbon atoms in a surfactant is from 14 to 20; $R^3$ is $C_1$–$C_4$ linear or branched alkylene, preferably ethylene, 1,2-propylene, 1,3-propylene, 1,2-butylene, 1,4-butylene, and mixtures thereof. However, a preferred embodiment of the present invention comprises from 1 to 3 units wherein $R^3$ is 1,2-propylene, 1,3-propylene, or mixtures thereof followed by the balance of the $R^3$ units comprising ethylene units. Another preferred embodiment comprises $R^3$ units which are randomly ethylene and 1,2-propylene units. The average value of the index m is at least about 0.01. When the index m has low values, the surfactant system comprises mostly alkyl sulfates with a small amount of alkyl alkoxy sulfate surfactant. Some tertiary carbon atoms may be present in the alkyl chain, however, this embodiment is not desired.

M denotes a cation, preferably hydrogen, a water soluble cation, and mixtures thereof. Non-limiting examples of water soluble cations include sodium, potassium, lithiurn, ammonium, alkyl ammonium, and mixtures thereof.

The preferred mid-chain branched alkyl sulfate and alkyl alkoxy sulfate surfactants of the present invention are "substantially linear" surfactants. The term "substantially linear" is defined for the purposes of the present invention as "alkyl units which comprise one branching unit or the chemical reaction products which comprise mixtures of linear (non-branched) alkyl units and alkyl units which comprise one branching unit". The term "chemical reaction products" refers to the admixture obtained by a process wherein substantially linear alkyl units are the desired product but nevertheless some non-branched alkyl units are formed. When this definition is taken together with preferably one of R, $R^1$, and $R^2$ is methyl and the other units are hydrogen, the preferred mid-chain branched alkyl sulfate and alkyl alkoxy sulfate surfactants comprise one methyl branch, preferably said methyl branch is not on the α, β, or the second to the last carbon atom. Typically the branched chains are a mixture of isomers.

The following illustrate preferred examples of mid-chain branched alkyl sulfate and alkoxy alkyl sulfate surfactants.

8-Methylundecyl sulfate:

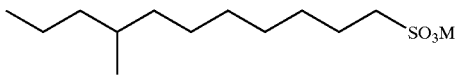

3-Methylundecyl sulfate:

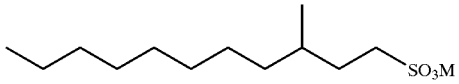

3-Methytridecyl sulfate:

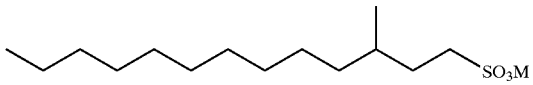

8-Methytrdecyl sulfate:

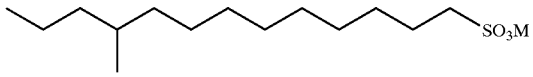

Mid-chain Branched Aryl Sulphonates

The surfactant systems of the present invention may comprise a mid-chain branched aryl sulphonate surfactant. Because mid-chain branched aryl sulfonate surfactants are not required when mid-chain branched alkyl sulfate and/or alkyl alkoxy surfactants are present, the surfactant system comprises from 0%, when present from 0.01%, preferably from about 0.1% more preferably from about 1% to about 100%, preferably to about 80% by weight, preferably to about 60%, most preferably to about 30% by weight, of the surfactant system. When the mid-chain branched aryl sulphonate surfactants comprise 100% of the surfactant system said mid-chain branched aryl sulphonate surfactants will comprise up to 60% by weight of the final laundry detergent composition.

The mid-chain branched aryl sulphonates of the present invention have the formula:

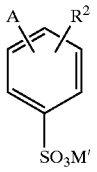

wherein A is a mid-chain branched alkyl unit having the formula:

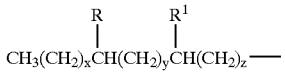

wherein R and $R^1$ are each independently hydrogen, $C_1$–$C_3$ alkyl, and mixtures thereof, provided at least one of R and $R^1$ is not hydrogen; preferably at least one R or $R^1$ is methyl; wherein the total number of carbon atoms in said alkyl unit is from 6 to 18. Some tertiary carbon atoms may be present in the alkyl chain, however, this embodiment is not desired.

The integer x is from 0 to 13. The integer y is from 0 to 13. The integer z is either 0 or 1, preferably 0.

$R^2$ is hydrogen, $C_1$–$C_3$ alkyl, and mixtures thereof. Preferably $R^2$ is hydrogen.

M' denotes a water soluble cation with sufficient charge to provide neutrality, preferably hydrogen, a water soluble cation, and mixtures thereof. Non-limiting examples of water soluble cations include sodium, potassium, lithium, ammonium, alkyl ammonium, and mixtures thereof.

The preferred mid-chain branched aryl sulphonate surfactants of the present invention are "substantially linear aryl" surfactants. The term "substantially linear aryl" is defined for the purposes of the present invention as "an alkyl unit which is taken together with an aryl unit wherein said alkyl unit preferably comprises one branching unit, however, a non-branched linear alkyl unit having an aryl unit bonded to the 2-carbon position as part of an admnixture is included as a substantially linear aryl surfactant". The preferred alkyl units do not have a methyl branch on the second to the last carbon atom. Typically the branched chains are a mixture of isomers. However, in the case of the mid-chained branched aryl sulphonates of the present invention, the relative position of the aryl moiety is key to the functionality of the surfactant. Preferably the aryl moiety is attached to the second carbon atom in the branched chain as illustrated herein below.

The preferred mid-chain branched aryl sulphonates of the present invention will comprise a mixture of branched chains. Preferably $R^1$ is methyl, the index z is equal to 0, and the sulphate moiety is para (1,4) to the branched alkyl substituent thereby resulting in a "2-phenyl aryl sulphonate" defined herein by the general formula:

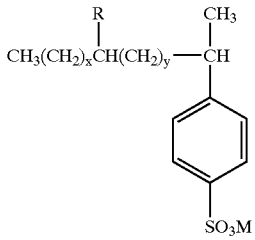

Typically 2-phenyl aryl sulphonates are formed as a mixture together with "3-phenyl aryl sulphonates" defined herein by the general formula:

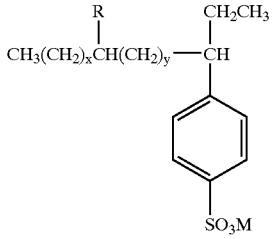

The surfactant properties of the mid-chain branched aryl sulphonates of the present invention can be modified by varying the ratio of 2-phenyl to 3-phenyl isomers in the final surfactant mixture. A convenient means for describing the relative amounts of isomers present is the "2/3 phenyl index" defined herein as "100 times the quotient of the amount of 2-phenyl isomer present divided by the amount of the 3-phenyl isomer which is present". Any convenient means, NMR, inter alia, can be used to determine the relative amounts of isomers present. A preferred 2/3 phenyl index is at least about 275 which corresponds to at least 2.75 times more 2-phenyl isomer present than the 3-phenyl isomer in the surfactant mixture. The preferred 2/3-phenyl index according to the present invention is from about 275, more preferably from about 350, most preferably from about 500 to about 10,000, preferably to about 1200, more preferably to about 700.

Those of ordinary skill in the art will recognize that the mid-chain branched surfactants of the present invention will be a mixture of isomers and the composition of the mixture will vary depending upon the process which is selected by the formulator to make the surfactants. For example, the following admixture is considered to comprise a substantially linear mid-chain branched aryl sulphonate admixture according to the present invention. Sodium para-(7-methylnonan-2-yl)benzenesulphonate, sodium para-(6methylnonan-2-yl)benzenesulphonate, sodium para-(7-methylnonan-3-yl)benzene-sulphonate, sodium para-(7-methyldecan-2-yl)benzenesulphonate, sodium para-(7-methylnonanyl)benzenesulphonate.

The following is an illustrative example of an process for preparing a substantially linear mid-chain branched aryl sulfonate.

EXAMPLE 5

Preparation of a Mid-chain Branched Aryl Sulphonate Surfactant Admixture Suitable for Use as a Mid-chain Branched Surfactant System An admixture of 2-hexanone (28 g, 0.28 mol), 2-heptanone (28 g, 0.25 mol), and 2-octanone (14 g, 0.11 mol) in anhydrous diethyl ether (100 g) is charged to an addition funnel. The ketone admixture is added dropwise over a period of 1.75 hours to a nitrogen blanketed, mechanically stirred three neck round bottom flask, fitted with a reflux condenser containing a 2.0 M solution of hexylmagnesium bromide (350 mL) in diethyl ether further diluted with additional anhydrous diethyl ether (100 mL). After the addition is complete, the reaction mixture is stirred an additional 1 hour at 20° C. The reaction mixture is then added to 600 g of a mixture of ice and water with stirring. To this solution is added a 30% sulfuric acid solution (228.6 g). The resulting two liquid phases are added to a separatory funnel. The aqueous layer is removed and the organic phase is extracted twice with water (600 mL). The organic layer is dried and the solvent removed in vacuo to yield 115.45 g of the desired alcohol mixture.

A portion of the alcohol mixture (100 g) is charged to a glass autoclave liner together with benzene (300 mL) and a shape selective zeolite catalyst (acidic mordenite catalyst Zeocat™ FM-8/25H) (20 g). The glass liner is fitted into a stainless steel, rocking autoclave. The autoclave system is purged twice with 250 psig $N_2$, and then charged to 1000 psig $N_2$. With mixing, the solution is heated to 170° C. for 14–15 hours. After cooling, the reaction product is filtered to remove catalyst and concentrated by distilling off any excess benzene. A mixture of a "lightly branched olefin mixture" is obtained.

A portion of the lightly branched olefin mixture (50 g) is charged to a glass autoclave liner. Benzene (150 mL) and a shape selective zeolite catalyst (acidic mordenite catalyst Zeocat™ FM-8/25H) (10 g) are added. The glass liner is placed inside a stainless steel, rocking autoclave. The autoclave is purged twice with 250 psig $N_2$, and then charged to 1000 psig $N_2$. With mixing, the solution is heated to 195° C. for 14–15 hours. After cooling the reaction product is filtered to remove catalyst and concentrated by distilling off any excess benzene. A clear liquid product is obtained. The product is distilled under vacuum (1–5 mm of Hg) to afford a fraction which distills from 95° C.–135° C. containing the desired "lightly branched alkylbenzene" admixture.

The lightly branched alkylbenzene fraction is treated with a molar equivalent of $SO_3$, the resulting product is neutralized with sodium methoxide in methanol, and the methanol evaporated to give a mid-chain branched aryl sulphonate surfactant admixture which can be directly used in the surfactant system of the present invention.

Optional Surfactants

The laundry detergent compositions of the present invention may optionally comprise at least about 0.01% by weight, preferably from about 0.1% to about 90%, preferably to about 60% more preferably to about 30% by weight, of the surfactant system, a non mid-chain branched alkyl sulfate or non-mid chain branched aryl sulphonate surfactant. Depending upon the embodiment of the present invention one or more categories of surfactants may be chosen by the formulator. Preferred categories of surfactants are selected from the group consisting of anionic, caution, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having the formula:

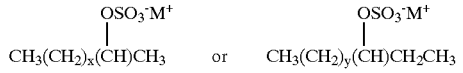

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates ($AE_xS$) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

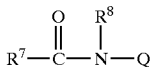

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_n CH_2OH$, $—CH(CH_2OH)(CHOH)_n—_1CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

FORMULATIONS

As described herein above the compositions of the present invention may be in any form inter alia liquid, granular, paste. Depending upon the specific form of the laundry composition, as well as, the expected use thereof, the formulator may will use different polyamine/branched surfactant combinations.

The formulations of the present invention are not restricted to laundry compositions but can be any type of surfactant comprising cleaner, inter alia, rug shampoos, hard surface cleaners. The formulations which benefit from the combination of polyamines and mid-chain branched surfactants include formulations which comprise:

a) from about 0.01%, preferably from about 0.1%, more preferably from 1%, most preferably from 3% to about 20%, preferably to about 10%, more preferably to about 5% by weight, of a polyamine as described herein;

b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) optionally and preferably, from 0.01%, preferably from about 0.1% more preferably from about 1% to about 100%, preferably to about 80% by weight, preferably to about 60%, most preferably to about 30% by weight, of one or more anionic surfactants;

iii) optionally, from 0.01%, preferably from about 0.1% more preferably from about 1% to about 100%, preferably to about 80% by weight, preferably to about 60%, most preferably to about 30% by weight, of one or more nonionic surfactants.

c) optionally from about 1%, preferably from about 10%, more preferably from about 20% to about 80%, preferably to about 60%, more preferably to about 45% by weight, of a fabric softening active;

d) optionally less than about 15% by weight, of a principal solvent, preferably said principal solvent has a ClogP of from about 0.15 to about 1;

d) optionally from about 0.001% to about 90% by weight, of one or more dye fixing agents;

f) optionally from about 0.01% to about 50% by weight, of one or more cellulose reactive dye fixing agents;

g) optionally from about 0.01% to about 15% by weight, of a chlorine scavenger;

h) optionally about 0.005% to about 1% by weight, of one or more crystal growth inhibitors;

i) optionally from about 1% to about 12% by weight, of one or more liquid carriers;

j) optionally from about 0.001% to about 1% by weight, of an enzyme;

k) optionally from about 0.01% to about 8% by weight, of a polyolefin emulsion or suspension;

l) optionally from about 0.01% to about 0.2% by weight, of a stabilizer;

m) optionally from about 1% to about 80% by weight, of a fabric softening active;

n) from about 0.01% by weight, of one or more linear or cyclic polyamines which provide bleach protection; and o) the balance carrier and adjunct ingredients.

Preferably the Heavy Duty Granular compositions according to the present invention comprise:

a) from about 0.01%, preferably from about 0.1%, more preferably from 1%, most preferably from 3% to about 20%, preferably to about 10%, more preferably to about 5% by weight, of a polyamine as described herein; and b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) optionally and preferably, from 0.01%, preferably from about 0.1% more preferably from about 1% to about 100%, preferably to about 80% by weight, preferably to about 60%, most preferably to about 30% by weight, of one or more anionic surfactants;

iii) optionally, from 0.01%, preferably from about 0.1% more preferably from about 1% to about 100%, preferably to about 80% by weight, preferably to about 60%, most preferably to about 30% by weight, of one or more nonionic surfactants.

HDG laundry detergent compositions will typically comprise more of anionic detersive surfactants. The formulator may add more or less "non" mid-chain branched surfactants depending upon, inter alia, water hardness. Neutral polyamines, PEI 1800 E7, PEI 600 E20, inter alia, are suitable for use in HDG formulations. However, in the instance of very high water hardness, a zwitterionic polyamine may be preferred. For the purpose of the present invention the term "hardness" relates to the amount of cations, calcium, inter alia, which are dissolved in the water and which tend to diminish the surfactancy and cleaning capacity of surfactants. The term "hard water" is a relative term and for the purposes of the present invention, water having at least "12 grams per gallon water (gpg, "American grain hardness" units) of calcium ion" is defined as "high hardness" and water having at least "18 gpg of calcium ion" is defined as "very high hardness". In one non-limiting example, the formulator will employ a polyamine having a greater number of anionic units on the tethering backbone modifications than the number of backbone caution units. This net charge balance has the effect of ameliorating the negative interaction of the surfactant molecules with the hydrophilic soil active polymers in high water hardness conditions.

An example of a zwitterionic polymer useful in high water hardness compositions has the formula:

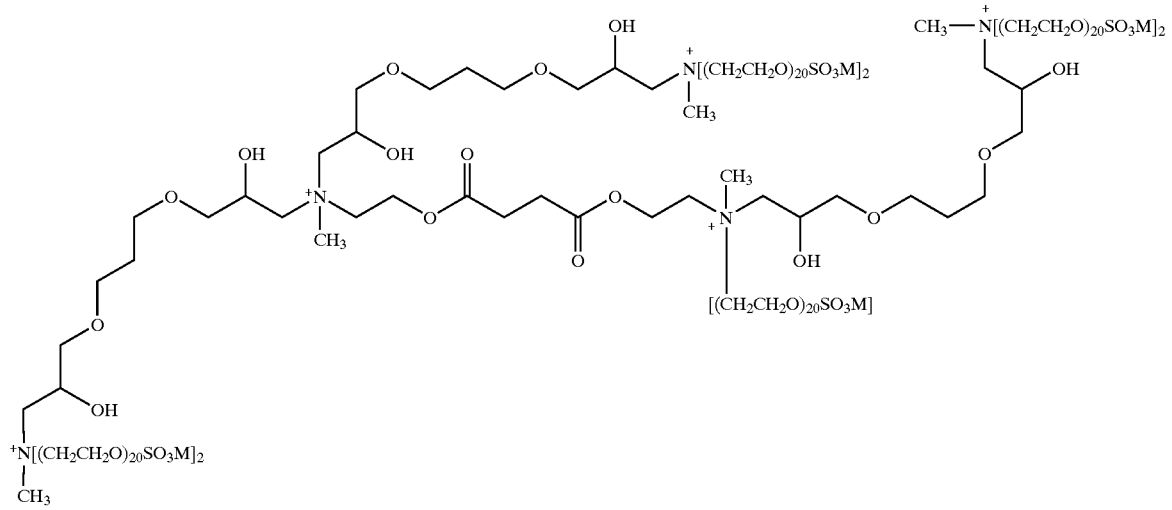

wherein the backbone is a hybrid backbone comprising 5 caution units and the backbone tethers which modify the polyamine comprise 7 anionic units.

A formulation which is capable of providing enhanced fabric benefits wherein the polyamine does not comprise an oxidized backbone comprises:

a) from about 0.01%, preferably from about 0.1%, more preferably from 1%, most preferably from 3% to about 20%, preferably to about 10%, more preferably to about 5% by weight, of a bleach stable polyamine which comprises no N-oxide units, having the formula:

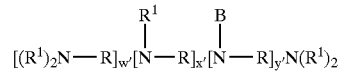

wherein each R unit is an ethylene or propylene unit; $R^1$ units are $—[CH_2CH(OR^4)CH_2O]^s—(R^2O)_tY$ units; wherein $R^2$ is ethylene, 1,2-propylene, and mixtures thereof; Y is hydrogen, and the value of the index s is 0. Preferably the values of the indices w', x', and y' are such that the polyamine has a backbone molecular weight prior to modification of from 600 daltons to about 3000 daltons;

b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) preferably, from 0.01%, preferably from about 0.1% more preferably from about 1% to about 100%, preferably to about 80% by weight, preferably to about 60%, most preferably to about 30% by weight, of one or more nonionic surfactants, said nonionic surfactants selected form the group consisting of alcohols, alcohol ethoxylates, polyoxyallylene alkylamides, and mixtures thereof;

iii) optionally, from 0.01%, preferably from about 0.1% more preferably from about 1% to about 100%, preferably to about 80% by weight, preferably to about 60%, most preferably to about 30% by weight, of one or more nonionic surfactants; and c) the balance carriers and adjunct ingredients.

An example of a Heavy Duty Liquid (HDL) composition according to the present invention comprises:

a) from about 0.01%, preferably from about 0.1%, more preferably from 1%, most preferably from 3% to about 20%, preferably to about 10%, more preferably to about 5% by weight, of a polyamine as described herein;

b) from about 0.01% by weight, preferably from about 0.1% more preferably from about 1% to about 60%, preferably to about 30% by weight, of said composition, of a surfactant system, said surfactant system comprising:

i) from 0.01%, preferably from about 0.1% more preferably from about 1% to about 100%, preferably to about 80% by weight, preferably to about 60%, most preferably to about 30% by weight, of a surfactant selected from the group consisting of mid-chain branched alkyl sulfate surfactants, mid-chain branched alkoxy sulfate surfactants, mid-chain branched aryl sulfonate surfactants, and mixtures thereof;

ii) preferably, from 0.01%, preferably from about 0.1% more preferably from about 1% to about 100%, preferably to about 80% by weight, preferably to about 60%, most preferably to about 30% by weight, of one or more nonionic surfactants, said nonionic surfactants selected form the group consisting of alcohols, alcohol ethoxylates, polyoxyalkylene alkylamides, and mixtures thereof;

iii) optionally, from 0.01%, preferably from about 0.1% more preferably from about 1% to about 100%, preferably to about 80% by weight, preferably to about 60%, most preferably to about 30% by weight, of one or more nonionic surfactants; and c) the balance carriers and adjunct ingredients.

HDL laundry detergent compositions will typically comprise more of a lesser amount of an anionic detersive surfactant and more nonionic surfactants. Therefore, in one preferred type of embodiment, the formulator may employ a zwitterionic polyamine having an equal number of anionic units as the number of caution units or a greater number of caution backbone units than the number of anionic units.

A non-limiting example of a nonionic surfactant suitable for use in the present invention has the formula:

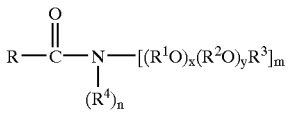

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof.

$R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably an $R^2$ units (i.e. 1,2-propylene) is attached to the nitrogen atom followed by the balance of the chain comprising from 4 to 8 ethylene units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a —$[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one —$[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

Suitable means for preparing the polyoxyalkylene alkylamide surface active agents of the present invention can be found in "Surfactant Science Series", Editor Martin Schick, Volume I, Chapter 8 (1967) and Volume XIX, Chapter 1 (1987) included herein by reference.

BLEACHING SYSTEM

The clay soil removal laundry detergent compositions of the present invention may optionally comprise a bleaching system. Bleaching systems typically comprise a "bleaching agent" (source of hydrogen peroxide) and an "initiator" or "catalyst".

Compositions of the present invention which comprise a bleaching system, comprise:

a) from about 0.01% by weight of a polyamine according to the present invention;

b) from about 0.01% by weight, of a surfactant system comprising:

i) from 0% to 80% by weight, of a mid-chain branched alkyl sulfate surfactant;

ii) from 0% to 80% by weight, of a mid-chain branched aryl sulfonate surfactant;

iii) optionally from 0.01% by weight, of a surfactant selected from the group consisting of anionic, nonionic, caution, zwitterionic, ampholytic surfactants, and mixtures thereof;

c) from about 1%, preferably from about 5% to about 80%, preferably to about 50% by weight, of a peroxygen bleaching system comprising:

i) from about 40%, preferably from about 50%, more preferably from about 60% to about 100%, preferably to about 95%, more preferably to about 80% by weight, of the bleaching system, a source of hydrogen peroxide;

ii) optionally from about 0.1%, preferably from about 0.5% to about 60%, preferably to about 40% by weight, of the beaching system, a beach activator;

iii) optionally from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst;

iv) optionally from about 0.1% by weight, of a preformed peroxygen bleaching agent; and d) the balance carriers and other adjunct ingredients.

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

Sources of hydrogen peroxide which are suitable for use in the compositions of the present invention include, but are not limited to, perborates, percarbonates, perphosphates, persulfates, and mixtures thereof. Preferred sources of hydrogen peroxide are sodium perborate monohydrate, sodium perborate tetrahydrate, sodium percarbonate and sodium persulfate, more preferably are sodium perborate monohydrate, sodium perborate tetrahydrate, and sodium percarbonate. When present the source of hydrogen peroxide is present at a level of from about 40%, preferably from about 50%, more preferably from about 60% to about 100%, preferably to about 95%, more preferably to about 80% by weight, of the bleaching system. Embodiments which are bleach comprising pre-soak compositions may comprise from 5% to 99% of the source of hydrogen peroxide.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants.

Bleach Activators

Preferably, the source of hydrogen peroxide (peroxygen bleach component) in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Also, bleach activators will comprise from about 0.1% to about 60% by weight, of the beaching system. When the herein described bleaching system comprises 60% by weight, of an activator (the maximal amount) and said composition (bleaching composition, laundry detergent, or otherwise) comprises 15% by weight of said activator (the maximal amount by weight), said composition will comprise 25% by weight of a bleaching system (60% of which is bleach activator, 40% a source of hydrogen peroxide). However, this is not meant to restrict the formulator to a 60:40 ratio of activator to hydrogen peroxide source.

Preferably the mole ratio of peroxygen bleaching compound (as AvO) to bleach activator in the present invention generally ranges from at least 1:1, preferably from about 20:1, more preferably from about 10:1 to about 1:1, preferably to about 3:1.

Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564; acyl lactam activators, as described in U.S. Pat. No. 5,698,504, U.S. Pat. No. 5,695,679 and U.S. Pat. No. 5,686,014, each of which is cited herein above, are very useful herein, especially the acyl caprolactams (see for example WO 94-28102 A) and acyl valerolactans, U.S. Pat. No. 5,503,639 Willey et al., issued Apr. 2, 1996 all of which are incorporated herein by reference.

Quaternary substituted bleach activators may also be included. The present cleaning compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. No. 5,698,504, U.S. Pat. No. 5,695,679, and U.S. Pat. No. 5,686,014 each of which are cited herein above. Preferred examples of such bleach activators include: (6-octanamidocaproyl) oxybenzenesulfonate, (6-nonanamidocaproyl) oxybenzenesulfonate, (6-decanamidocaproyl) oxybenzenesulfonate and mixtures thereof.

Other useful activators, disclosed in U.S. Pat. No. 5,698,504, U.S. Pat. No. 5,695,679, U.S. Pat. No. 5,686,014 each of which is cited herein above and U.S. Pat. No. 4,966,723Hodge et al., issued Oct. 30, 1990, include benzoxazin-type activators, such as a $C_6H_4$ ring to which is fused in the 1,2-positions a moiety —C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Transition Metal Bleach Catalyst

The laundry detergent compositions of the present invention optionally comprises a bleaching system which contains one or more bleach catalysts. Selected bleach catalysts inter alia 5,12-dimethyl-1,5,8,12-tertaza-bicyclo[6.6.2] hexadecane manganese (II) chloride may be formulated into bleaching systems which do not require a source of hydrogen peroxide or peroxygen bleach. The compositions comprise from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst Non-limiting examples of suitable manganese-based catalysts are disclosed in U.S. Pat. No. 5,576,282 Miracle et al., issued Nov. 19, 1996; U.S. Pat. No. 5,246,621 Favre et al., issued Sep. 21, 1993; U.S. Pat. No. 5,244,594 Favre et al., issued Sep. 14, 1993; U.S. Pat. No. 5,194,416 Jureller et al., issued Mar. 16, 1993; U.S. Pat. No. 5,114,606 van Vliet et al., issued May 19, 1992; U.S. Pat. No. 4,430,243 Bragg, issued Feb. 7, 1984; U.S. Pat. No. 5,114,611 van Kralingen, issued May 19, 1992; U.S. Pat. No. 4,728,455 Rerek, issued Mar. 1, 1988; U.S. Pat. No. 5,284,944 Madison, issued Feb. 8, 1994; U.S. Pat. No. 5,246,612 van Dijk et al., issued Sep. 21, 1993; U.S. Pat. No. 5,256,779 Kerschner et al., issued Oct. 26, 2993; U.S. Pat. No. 5,280,117 Kerschner et al., issued Jan. 18, 1994; U.S. Pat. No. 5,274,147 Kerschner et al., issued Dec. 28, 1993; U.S. Pat. No. 5,153,161 Kerschner et al., issued Oct. 6, 1992; and U.S. Pat. No. 5,227,084 Martens et al., issued Jul. 13, 1993; and European Pat. App. Pub. Nos. 549,271 A1, 549,272 A1, 544,440 A2, and 544, 490 A1.

Non-limiting examples of suitable cobalt-based catalysts are disclosed in U.S. Pat. No. 5,597,936 Perkins et al., issued Jan. 28, 1997; U.S. Pat. No. 5,595,967 Miracle et al., issued Jan. 21, 1997; U.S. Pat. No. 5,703,030 Perkins et al., issued Dec. 30, 1997; U.S. Pat. No. 4,810,410 Diakun et al, issued Mar. 7,1989; M. L. Tobe, "Base Hydrolysis of Transition-Metal Complexes", *Adv. Inorg. Bioinorg. Mech.*, (1983), 2, pages 1–94; *J. Chem. Ed.* (1989), 66 (12), 104–345; The Synthesis and Characterization of Inorganic Compounds, W. L. Jolly (Prentice-Hall; 1970), pp. 461–3; *Inorg. Chem.*, ~1497–1502 (1979); *Inorg. Chem.*, 21, 2881–2885 (1982); *Inorg. Chem.*, 18, 2023–2025 (1979); Inorg. Synthesis, 173–176 (1960); and *Journal of Physical Chemistry*, 56, 22–25 (1952).

Further examples of preferred macrocyclic ligand comprising bleach catalysts are described in WO 98/39406 A1 published Sep. 11, 1998 and included herein by reference. Suitable examples of these bleach catalysts include:

Dichloro-5,12-dimethyl-1,5,8,12-tetazabicyclo[6.6.2] hexadecane manganese(II)

Diaquo-5,12-dimethyl-1,5,8,12-tetazabicyclo[6.6.2] hexadecane manganese(II)hexafluorophosphate Aquo-hydroxy-5,12-dimethyl-1,5,8,12-tetraazabicyclo [6.6.2]hexadecane manganese(III)hexafluorophosphate Diaquo-5,12-dimethyl-1,5,8,12-tetraazabicyclo[6.6.2] hexadecane manganese(II)tetrafluoroborate Dichloro-5,12-dimethyl-1,5,8,12-tetraazabicyclo[6.6.2] hexadecane manganese(III)hexafluorophosphate Dichloro-5,12-di-n-butyl-1,5,8,12-tetraazabicyclo[6.6.2] hexadecane manganese(II)

Dichloro-5,12-dibenzyl-1,5,8,12-tetraazabicyclo[6.6;2] hexadecane manganese(II)

Dichloro-5-n-butyl-12-methyl-1,5,8,12-tetraaza-bicyclo [6.6.2]hexadecane manganese(II)

Dichloro-5-n-octyl-12-methyl-1,5,8,12-tetraaza-bicyclo [6.6.2]hexadecane manganese(II)

Dichloro-5-n-butyl-12-methyl-1,5,8,12-tetraaza-bicyclo [6.6.2]hexadecane manganese(II).

Pre-formed Bleaching Agents

The bleaching systems of the present invention may optionally further comprise from 0.1%, preferably from 1%, more preferably from 5% to about 10%, preferably to about 7% by weight, of one or more pre-formed bleaching agents. Pre-formed bleaching materials typically have the general formula:

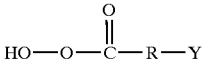

wherein R is a $C_1$–$C_{22}$ alkylene, $C_1$–$C_{22}$ substituted alkylene, phenylene, $C_6$–$C_{22}$ substituted phenylene, and mixtures thereof, Y is hydrogen, halogen, alkyl, aryl, —C(O)OH, —C(O)OOH, and mixtures thereof.

The organic percarboxylic acids usable in the present invention can contain either one or two peroxy groups and can be either aliphatic or aromatic. When the organic percarboxylic acid is aliphatic, the unsubstituted acid has the general formula:

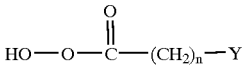

wherein Y can be hydrogen, methyl, methyl chloride, carboxylate, percarboxylate; and n is an integer having the value from 1 to 20.

When the organic percarboxylic acid is aromatic, the unsubstituted acid has the general formula:

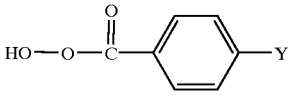

wherein Y can be hydrogen, alkyl, haloalkyl, carboxylate, percarboxylate, and mixtures thereof.

Typical monoperoxy percarboxylic acids useful herein include alkyl percarboxylic acids and aryl percarboxylic acids such as:

i) peroxybenzoic acid and ring-substituted peroxybenzoic acids, e.g., peroxy-o-naphthoic acid;

ii) aliphatic, substituted aliphatic and arylalkyl monoperoxy acids, e.g. peroxylauric acid, peroxystearic acid, and N,N-phthaloylaminoperoxycaproic acid (PAP).

Typical diperoxy percarboxylic acids useful herein include alkyl diperoxy acids and aryldiperoxy acids, such as:

iii) 1,12-diperoxydodecanedioic acid;

iv) 1,9-diperoxyazelaic acid;

v) diperoxybrassylic acid; diperoxysebacic acid and diperoxyisophthalic acid;

vi) 2-decyldiperoxybutane-1,4-dioic acid;

vii) 4,4'-sulfonybisperoxybenzoic acid.

A non-limiting example of a highly preferred pre-formed bleach includes 6-nonylamino-6-oxoperoxycaproic acid (NAPAA) as described in U.S. Pat. No. 4,634,551 Burns et al., issued Jan. 6, 1987 included herein by reference.

As well as the herein described peroxygen bleaching compositions, the compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

ADJUNCT INGREDIENTS

The following are non-limiting examples of adjunct ingredients useful in the laundry compositions of the present invention, said adjunct ingredients include builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

Builders—The laundry detergent compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$: $Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y].xH_2O$$

wherein z and y are integers of at least 6, the molar ratio of z to y is in the range from 1.0 to about 0.5, and x is an integer from about 15 to about 264.

Useful alumninosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline alumninosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymialeic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111, 984 Gosselinik, published Jun. 27, 1984; European Patent Application 112,592 Gosselink, published Jul. 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylates and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067 Diehl, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,843,878 Gosselink et al., issued Dec. 1, 1998; U.S. Pat. No. 5,834,412 Rohrbaugh et al., issued Nov. 10, 1998; U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451

Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie;. EP 457,205 A to BASF (1991); and DE 2,335,044 to Unilever N.V., 1974; all incorporated herein by reference.

METHOD OF USE

The present invention further relates to a method for removing hydrophilic soils form fabric, preferably clothing, said method comprising the step of contacting fabric in need of cleaning with an aqueous solution of a laundry detergent composition comprising:

a) from about 0.01% by weight of a polyamine according to the present invention;

b) from about 0.01% by weight, of a surfactant system comprising:
   i) from 0% to 80% by weight, of a mid-chain branched alkyl sulfate surfactant;
   ii) from 0% to 80% by weight, of a mid-chain branched aryl sulfonate surfactant;
   iii) optionally from 0.01% by weight, of a surfactant selected from the group consisting of anionic, nonionic, caution, zwitterionic, ampholytic surfactants, and mixtures thereof;

c) optionally from about 1%, preferably from about 5% to about 80%, preferably to about 50% by weight, of a peroxygen bleaching system comprising:
   i) from about 40%, preferably from about 50%, more preferably from about 60% to about 100%, preferably to about 95%, more preferably to about 80% by weight, of the bleaching system, a source of hydrogen peroxide;
   ii) optionally from about 0.1%, preferably from about 0.5% to about 60%, preferably to about 40% by weight, of the beaching system, a beach activator;
   iii) optionally from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst;
   iv) optionally from about 0.1% by weight, of a preformed peroxygen bleaching agent; and d) the balance carriers and other adjunct ingredients.

Preferably the aqueous solution comprises at least about 0.01% (100 ppm), preferably at least about 1% (1000 ppm)by weight, of said laundry detergent composition.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

The following are non-limiting examples of compositions according to the present invention.

TABLE I

| | weight % | | |
|---|---|---|---|
| Ingredients | 6 | 7 | 8 |
| Branched akyl sulfate[1] | 10.0 | 10.0 | 10.0 |
| Branched aryl sulphonate[2] | — | 10.0 | — |
| Sodium $C_{12}$–$C_{15}$ alcohol sulfate | 10.0 | — | — |
| Sodium linear alkylbenzene sulphonate | — | — | 10.0 |
| Sodium $C_{12}$–$C_{15}$ alcohol ethoxy (1.8) sulfate | 1.0 | — | — |
| Cationic surfactant[3] | 0.5 | 0.5 | — |
| Nonionic surfactant[4] | 0.63 | 0.63 | — |
| Polyamine[5] | 0.3 | 0.5 | 0.5 |
| Sodium carbonate | 25.0 | 17.0 | 25.0 |
| Builder[6] | 25.0 | 20.0 | 20.0 |
| Protease enzyme[7] | 0.70 | 0.70 | 0.70 |
| Protease enzyme | 0.70 | — | 0.70 |
| Dispersant[9] | 1.0 | 1.0 | 2.0 |
| Soil release polymer[10] | 0.50 | 0.50 | 0.50 |
| Bleaching system[11] | 8.0 | — | 6.0 |
| Minors[11] | balance | balance | balance |

[1]$C_{10}$–$C_{13}$ mid-chain branched alkyl sulfate admixture.
[2]Mid-chain branched aryl sulphonate admixture according to Example 5.
[3]Coconut trimethylammonium chloride.
[4]NEODOL 23-9 ex Shell Oil Co.
[5]Polyalkyleneimine having a backbone molecular weight of 600 daltons and an average of 20 ethyleneoxy units substituted for each hydrogen atom bonded to a backbone nitrogen (PEI 600 E20).
[6]Zeolite A, hydrate (0.1–10 micron size).
[7]Bleach stable variant of BPN' (Protease A-BSV) as disclosed in EP 130, 756 A January 9, 1985.
[8]Protease variants at position 103 of *Bacillus amyloliquefaciens* as described in WO9920727A1.
[9]Polyacrylate/maleate co-polymer.
[10]Soil release polymer according to U.S. Pat. No. 5,415,807 Gosselink et al., issued May 16, 1995.
[11]Bleaching system comprising NOBS (5%) and perborate (95%).
[12]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE II

| | weight % | | |
|---|---|---|---|
| Ingredients | 9 | 10 | 11 |
| Branched alkyl sulfate[1] | 20.0 | — | — |
| Branched aryl sulphonate[2] | — | 10.0 | 20.0 |
| Sodium $C_{12}$–$C_{15}$ alcohol sulfate | — | 10.0 | — |
| Sodium $C_{12}$–$C_{15}$ alcohol ethoxy (1.8) sulfate | 1.0 | — | — |
| Cationic surfactant[3] | — | 0.50 | 0.50 |
| Polyamine[4] | 0.25 | 0.50 | 0.50 |
| Sodium carbonate | 30.0 | 20.0 | 25.0 |
| Builder[5] | 20.0 | 25.0 | 21.0 |
| Protease enzyme[6] | 0.70 | 0.70 | — |
| Protease enzyme[7] | 0.70 | 0.70 | 0.70 |
| Protease enzyme[8] | 1.0 | 1.0 | — |
| Dispersant[9] | 1.0 | — | 1.0 |

TABLE II-continued

| Ingredients | weight % | | |
|---|---|---|---|
| | 9 | 10 | 11 |
| Soil release polymer[10] | — | 0.50 | 0.50 |
| Bleaching system[11] | — | 5.5 | 6.2 |
| Minors[12] | balance | balance | balance |

[1]$C_{10}$–$C_{13}$ mid-chain branched alkyl sulfate admixture.
[2]Mid-chain branched aryl sulphonate admixture according to Example 5.
[3]Coconut trimethylammonium chloride.
[4]Polyalkyleneimine having a backbone molecular weight of 1800 daltons and an average of 7 ethyleneoxy units substituted for each hydrogen atom bonded to a backbone nitrogen (PEI 1800 E7).
[5]Zeolite A, hydrate (0.1–10 micron size).
[6]Bleach stable variant of BPN' (Protease A-BSV) as disclosed in EP 130, 756 A January 9, 1985.
[7]Protease variants at position 103 of *Bacillus amyloliquefaciens* as described in WO9920727A1.
[7]ALCALASE ® ex Novo.
[8]Polyacrylate/maleate co-polymer.
[10]Soil release polymer according to U.S. Pat. No. 5,415,807 Gosselink et al., issued May 16, 1995.
[11]Bleaching system comprising NOBS (5%) and perborate (95%).
[12]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE III

| Ingredients | weight % | | |
|---|---|---|---|
| | 12 | 13 | 14 |
| Branched akyl sulfate[1] | 10.0 | 10.0 | 10.0 |
| Branched aryl sulphonate[2] | — | — | 10.0 |
| Sodium $C_{12}$–$C_{15}$ alcohol sulfate | 10.0 | 10.0 | — |
| Sodium linear alkylbenzene sulphonate | — | — | — |
| Sodium $C_{12}$–$C_{15}$ alcohol ethoxy (1.8) sulfate | 1.0 | — | — |
| Sodium $C_{12}$–$C_{15}$ alcohol ethoxy (2.25) sulfate | — | 1.0 | — |
| Cationic surfactant[3] | 0.5 | 0.5 | 0.50 |
| Nonionic surfactant[4] | 0.63 | — | 0.63 |
| Polyamine[5] | 0.30 | 0.50 | 0.25 |
| Sodium carbonate | 30.0 | 20.0 | 17.0 |
| Builder[6] | 25.0 | 35.0 | 30.0 |
| Protease enzyme[7] | 0.70 | 0.70 | 0.70 |
| Protease enzyme[8] | 0.70 | 0.70 | — |
| Protease enzyme[9] | — | 1.0 | 0.90 |
| Dispersant[10] | 1.0 | — | 1.0 |
| Soil release polymer[11] | 0.50 | 0.50 | 1.0 |
| Bleaching system[12] | 0.05 | 0.05 | 0.05 |
| Minors[13] | balance | balance | balance |

[1]$C_{10}$–$C_{13}$ mid-chain branched alkyl sulfate admixture.
[2]Mid-chain branched aryl sulphonate admixture according to Example 5.
[3]Coconut trimethylammonium chloride.
[4]NEODOL 23-9 ex Shell Oil Co.
[5]4,9-dioxa-1,12-dodecanediamine, ethoxylated to average E20 per NH, quaternized to 90%, and sulfated to 90%.
[6]Zeolite A, hydrate (0.1–10 micron size).
[7]Bleach stable variant of BPN' (Protease A-BSV) as disclosed in EP 130, 756 A January 9, 1985.
[8]Protease variants at position 103 of *Bacillus amyloliquefaciens* as described in WO9920727A1.
[9]ALCALASE ® ex Novo.
[10]Polyacrylate/maleate co-polymer.
[11]Soil release polymer according to U.S. Pat. No. 5,415,807 Gosselink et al., issued May 16, 1995.
[12]5,12-dimethyl-1,5,8,12-tetraaza-bicyclo[6.6.2]hexadecane manganese (II) chloride.
[13]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE IV

| Ingredients | Weight % | | | |
|---|---|---|---|---|
| | 15 | 16 | 17 | 18 |
| Sodium $C_{11}$–$C_{13}$ alkylbenzene-sulfonate | 15.00 | 14.45 | 6.00 | 10.00 |
| $C_{12}$–$C_{14}$ Dimethyl hydroxyethyl quaternary amine | 0.40 | 0.40 | — | — |
| $C_9$–$C_{14}$ Dimethyl hydroxyethyl quaternary amine | — | — | 1.0 | 1.0 |
| $C_{14}$–$C_{15}$ Alcohol ethoxylate (3) sulfate | — | — | 1.00 | 1.00 |
| Branched alkyl sulfate[1] | 12.00 | 10.00 | 12.00 | 10.00 |
| Polyamine[2] | 0.50 | 0.50 | 0.50 | 0.50 |
| Sodium tripolyphosphate | 28.00 | 25.00 | 20.00 | 24.00 |
| Zeolite | 12.00 | 14.50 | — | — |
| CMC | 1.10 | 1.10 | 0.50 | 0.50 |
| Soil Release Agent[3] | 0.15 | 0.15 | 0.15 | 0.15 |
| Sodium polyacrylate (MW = 4500) | 0.90 | — | — | — |
| Sodium Polyacrylate/maleate polymer | — | — | 1.00 | 1.00 |
| Enzymes; selected from amylase, cellulase, protease, and lipase | 0.54 | 0.46 | 2.00 | 2.00 |
| Nonanoyloxybenzene sulfonate | 1.71 | — | 0.70 | — |
| Sodium perborate | 3.5 | — | 3.00 | — |
| TAED | — | — | 0.30 | — |
| DTPA[4] | 0.90 | — | 0.80 | 0.80 |
| Magnesium sulfate | 1.18 | — | 1.00 | — |
| Optical Brightener | 0.20 | 0.30 | 0.20 | 0.30 |
| Photobleach[5] | 0.40 | 0.40 | — | — |
| Sodium carbonate | 23.00 | 22.74 | 13.00 | 13.00 |
| Sodium silicate | 2.00 | 2.00 | 9.00 | 9.00 |
| Sodium sulfate | — | — | 20.00 | 20.00 |
| Perfume | 0.36 | 0.36 | 0.40 | 0.40 |
| Minors including moisture | balance | balance | balance | balance |

[1]Mid-chain branched aryl sulphonate admixture according to Example 5
[2]Polyalkyleneimine having a backbone molecular weight of 3000 daltons and 3 propyleneoxy units followed by 27 ethyleneoxy units substituted for each hydrogen atom bonded to a backbone nitrogen (PEI 3000 P3E27).
[3]Soil release polymer according to U.S. Pat. No. 5,415,807 Gosselink et al., issued May 16, 1995.
[4]Diethylene triamine pentaacetate.
[5]Photobleach according to U.S. Pat. No. 4,255,273 Sakkab, issued March 10, 1981.

TABLE V

| Ingredients | weight % | | |
|---|---|---|---|
| | 19 | 20 | 21 |
| Branched alkyl sulfate[1] | 10.0 | — | 20.0 |
| Branched aryl sulphonate[2] | — | 20.0 | — |
| Sodium linear alkylbenzene sulphonate | 10.0 | — | — |
| Sodium $C_{12}$–$C_{15}$ alcohol ethoxy (1.8) sulfate | — | — | 1.0 |
| Sodium $C_{12}$–$C_{15}$ alcohol ethoxy (2.25) sulfate | 1.0 | — | — |
| Cationic surfactant[3] | — | 0.50 | — |
| Nonionic surfactant[4] | — | 0.7 | — |
| Polyamine[5] | 0.70 | 0.50 | 0.50 |
| Sodium carbonate | 25.0 | 25.0 | 30.0 |
| Builder[6] | 30.0 | 35.0 | 20.0 |
| Protease enzyme[7] | 0.80 | — | 0.80 |
| Protease enzyme[8] | 0.70 | 0.60 | 0.70 |
| Protease enzyme[9] | — | 1.0 | 1.0 |
| Dispersant[10] | 2.0 | 1.5 | 1.0 |
| Soil release polymer[11] | 0.50 | 0.50 | — |
| Bleaching system[12] | — | 0.02 | — |
| Minors[13] | balance | balance | balance |

[1]$C_{10}$–$C_{13}$ mid-chain branched alkyl sulfate admixture.
[2]Mid-chain branched aryl sulphonate admixture according to Example 5.
[3]Coconut trimethylammonium chloride.
[4]NEODOL 23-9 ex Shell Oil Co.
[5]Polyalkyleneimine having a backbone molecular weight of 1800 daltons and an average of 7 ethyleneoxy units substituted for each hydrogen atom bonded to a backbone nitrogen (PEI 1800 E7).

TABLE V-continued

| Ingredients | weight % 19 | 20 | 21 |
|---|---|---|---|

[6]Zeolite A, hydrate (0.1–10 micron size).

[7]Bleach stable variant of BPN' (Protease A-BSV) as disclosed in EP 130, 756 A January 9, 1985.

[8]Protease variants at position 103 of *Bacillus amyloliquefaciens* as described in W09920727A1.

[9]ALCALASE ® ex Novo.

[10]Polyacrylate/maleate co-polymer.

[11]Soil release polymer according to U.S. Pat. No. 5,415,807 Gosselink et al., issued May 16, 1995.

[12]5,12-dimethyl-1,5,8,12-tetraaza-bicyclo[6.6.2]hexadecane manganese (II) chloride.

[13]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE VI

| Ingredients | weight % 22 | 23 | 24 |
|---|---|---|---|
| Branched alkyl sulfate[1] | 10.0 | — | 10.0 |
| Branched aryl sulphonate[2] | — | 10.0 | 10.0 |
| Sodium $C_{12}$–$C_{15}$ alcohol sulfate | 10.0 | 10.0 | — |
| Sodium $C_{12}$–$C_{15}$ alcohol ethoxy (1.8) sulfate | 1.0 | — | — |
| Sodium $C_{12}$–$C_{15}$ alcohol ethoxy (2.25) sulfate | — | 1.0 | — |
| Cationic surfactant[3] | — | — | 0.70 |
| Nonionic surfactant[4] | 15.0 | 15.0 | 20.0 |
| Polyamine[5] | | | |
| Solvent[6] | 15.0 | 15.0 | 10.0 |
| Sodium carbonate | 10.0 | 10.0 | 7.0 |
| Builder[7] | 8.0 | 10.0 | 10.0 |
| Protease enzyme[8] | 0.70 | — | — |
| Protease enzyme[9] | — | 0.70 | — |
| Protease enzyme[10] | — | 1.00 | 1.00 |
| Dispersant[11] | 1.0 | — | 1.0 |
| Soil release polymer[12] | 0.50 | 0.50 | — |
| Bleaching system[13] | 8.0 | 5.5 | — |
| Bleaching system[14] | — | — | 0.05 |
| Minors[15] | balance | balance | balance |

[1]$C_{10}$–$C_{13}$ mid-chain branched alkyl sulfate admixture.
[2]Mid-chain branched aryl sulphonate admixture according to Example 5.
[3]Coconut triethylammonium chloride.
[4]NEODOL 23-9 ex Shell Oil Co.
[5]Bis(hexamethylene)triamine, ethoxylated to average E20 per NH, quaternized to 90%, and sulfated to 35%.
[6]Ethanol.
[7]Admixture of citrates.
[8]Bleach stable variant of BPN' (Protease A-BSV) as disclosed in EP 130, 756 A January 9, 1985.
[9]Protease variants at position 103 of *Bacillus amyloliquefaciens* as described in W09920727A1.
[10]ALCALASE ® ex Novo.
[11]Polyacrylate/maleate co-polymer.
[12]Soil release polymer according to U.S. Pat. No. 5,415,807 Gosselink et al., issued May 16, 1995.
[13]Bleaching system comprising NOBS (5%) and perborate (95%).
[14]5,12-dimethyl-1,5,8,12-tetraaza-bicyclo[6.6.2]hexadecane manganese (II) chloride.
[15]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

TABLE VII

| Ingredients | weight % 25 | 26 | 27 |
|---|---|---|---|
| Branched alkyl sulfate[1] | 10.0 | — | 20.0 |
| Branched aryl sulphonate[2] | — | 20.0 | — |
| Sodium $C_{12}$–$C_{15}$ alcohol sulfate | 10.0 | — | — |
| Sodium linear alkylbenzene sulphonate | — | 10.0 | — |
| Sodium $C_{12}$–$C_{15}$ alcohol ethoxy (1.8) sulfate | — | — | 1.0 |
| Cationic surfactant[3] | — | 0.50 | — |
| Nonionic surfactant[4] | 17.0 | 17.0 | 10.0 |
| Polyamine[5] | 1.00 | 0.50 | 0.75 |
| Solvent[6] | 20.0 | 18.0 | 20.0 |
| Sodium carbonate | — | 12.0 | — |
| Builder[7] | 10.0 | 8.0 | 6.0 |
| Protease enzyme[8] | 0.70 | — | — |
| Protease enzyme[9] | — | — | 0.70 |
| Protease enzyme[10] | — | — | 1.00 |
| Dispersant[11] | 2.0 | 1.0 | 1.0 |
| Soil release polymer[12] | 0.50 | 0.50 | — |
| Bleaching system[13] | 6.0 | 6.2 | — |
| Bleaching system[14] | — | — | 0.05 |
| Minors[15] | balance | balance | balance |

[1]$C_{10}$–$C_{13}$ mid-chain branched alkyl sulfate admixture.
[2]Mid-chain branched aryl sulphonate admixture according to Example 5.
[3]Coconut trimethylammonium chloride.
[4]NEODOL 23-9 ex Shell Oil Co.
[5]Tris(hexamethylene)tetraamine, ethoxylated to average E20 per NH, quaternized to 90%, and sulfated to 35%.
[6]Ethanol.
[7]Admixture of citrates.
[8]Bleach stable variant of BPN' (Protease A-BSV) as disclosed in EP 130, 756 A January 9, 1985.
[9]Protease variants at position 103 of *Bacillus amyloliquefaciens* as described in W09920727A1.
[10]ALCALASE ® ex Novo.
[11]Polyacrylate/maleate co-polymer.
[12]Soil release polymer according to U.S. Pat. No. 5,415,807 Gosselink et al., issued May 16, 1995.
[13]Bleaching system comprising NOBS (5%) and perborate (95%).
[14]5,12-dimethyl-1,5,8,12-tetraaza-bicyclo[6.6.2]hexadecane manganese (II) chloride.
[15]Balance to 100% can, for example, include minors like optical brightener, perfume, suds suppresser, soil dispersant, chelating agents, dye transfer inhibiting agents, additional water, and fillers, including $CaCO_3$, talc, silicates, etc.

What is claimed is:

1. A laundry detergent composition comprising:

a) from about 0.01% to about 20% by weight, of a polyamine, said polyamine having the formula;

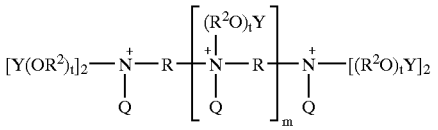

wherein R is a backbone unit selected from the group consisting of:

i) $C_6$–$C_{16}$ substituted or unsubstituted arylene, $C_7$–$C_{40}$ substituted or unsubstituted alkylenearylene having the formula:

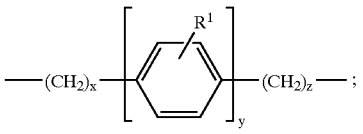

or mixtures thereof:

ii) hydroxyalkylene units having the formula:

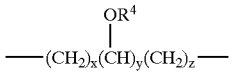

iii) hydroxyalkylene/oxyalkylene units having the formula:

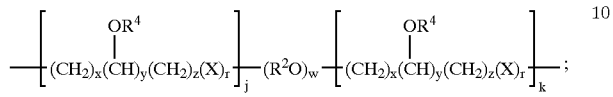

iv) a carboxyalkyleneoxy units having the formula:

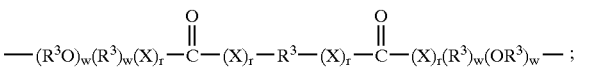

v) and mixtures thereof;

Y is an anionic unit selected from the group consisting of $—(CH_2)_fCO_2M$, $—C(O)(CH_2)_fCO_2M$, $—(CH_2)_fPO_3M$, $—(CH_2)_fOPO_3M$, $—(CH_2)_fSO_3M$, $—CH_2(CHSO_3M)—(CH_2)_fSO_3M$, $—CH_2(CHSO_2M)—(CH_2)_fSO_3M$, $—C(O)CH_2CH(SO_3M)CO_2M$, $—C(O)CH_2CH(CO_2M)NHCH—(CO_2M)CH_2CO_2M$, $—CH_2CH(OZ)CH_2O(R^1O)_fZ$, $—(CH_2)_fCH[O(R^2O)_fZ]CH_fO—(R^2O)_fZ$, and mixtures thereof, wherein Z is hydrogen or an anionic unit selected from the group consisting of $—(CH_2)_fCO_2M$, $—C(O)(CH_2)_fCO_2M$, $—(CH_2)_fPO_3M$, $—(CH_2)_fOPO_3M$, $—(CH_2)_fSO_3M$, $—CH_2(CHSO_3M)—(CH_2)_f SO_3M$, $—CH_2(CHSO_2M)(CH_2)_fSO_3M$, $—C(O)CH_2CH(SO_3M)CO_2M$, $—C(O)CH_2CH(CO_2M)NHCH(CO_2M)CH_2CO_2M$, and mixtures thereof; M is hydrogen, a water soluble cation, and mixtures thereof; the index f is from 0 to about 6; the index m is from 0 to 20; $R^1$ is selected from the group consisting of:

i) hydrogen;
ii) $C_1$–$C_{22}$ alkyl;
iii) $C_7$–$C_{22}$ arylenealkyl;
iv) $C_7$–$C_{22}$ alkylenearyl;
v) $—[CH_2CH(OR^4)CH_2O]_f(R^2O)_tY$;
vi) anionic units;
vii) and mixtures thereof;

$R^2$ is selected from the group consisting of ethylene, 1,2-propylene, 1,3-propylene, 1,2-butylene, 1,4-butylene, 1,6 hexylene, 1,2-hexylene, and mixtures thereof;

$R^3$ is $C_2$–$C_8$ linear alkylene, $C_3$–$C_8$ branched alkylene, phenylene, substituted phenylene, and mixtures thereof; $R^4$ is hydrogen, $C_1$–$C_6$ alkyl, $—(CH_2)_u(R^2O)_t(CH_2)_uY$, and mixtures thereof; wherein index s is from 0 to 5; the index t is from 0.5 to 100; the index u is from 0 to 6; index w is from 0 to 25; indices x and z are each independently from 0 to 20 and indice y is from 1 to 20; X is oxygen or the amino unit $—NR^4—$, the index r is 0 or 1; indices i and k are each independently from 1 to 20;

O is a quaternizing unit selected from the group consisting of $C_1$–$C_4$ linear alkyl, $C_1$–$C_4$ hydroxyalkyl, benzyl, $—[CH_2CH(OR^4)CH_2O](R^2O)_tY$, and mixtures thereof;

b) from about 0.01% to about 60% of a surfactant system comprising:

i) from 0% to 80% by weight, of a mid-chain branched alkyl sulfate surfactant selected from the group consisting of surfactants having the formula:

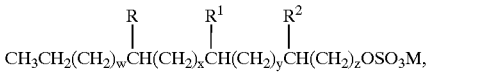

the formula:

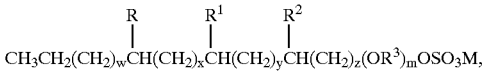

and mixtures thereof; wherein R, $R^1$, and $R^2$ of the mid-chain branched alkyl sulfate surfactant are each independently hydrogen, $C_1$–$C_3$ alkyl, and mixtures thereof, provided the total number of carbon atoms in said surfactant is from 14 to 20 and at least one of R, $R^1$, and $R^2$ of the mid-chain branched alkyl sulfate surfactant is not hydrogen; the index w of the mid-chain branched alkyl sulfate surfactant is an integer from 0 to 13; x of the mid-chain branched alkyl sulfate surfactant is an integer from 0 to 13; y of the mid-chain branched alkyl sulfate surfactant is an integer from 0 to 13; z of the mid-chain branched alkyl sulfate surfactant is an integer of at least 1; provided w+x+y+z of the mid-chain branched alkyl sulfate surfactant is from 8 to 14 and the total number of carbon atoms in a surfactant is from 14 to 20; $R^3$ of the mid-chain branched alkyl sulfate surfactant is ethylene, 1,2-propylene, 1,3-propylene, 1,2-butylene, 1,4-butylene, and mixtures thereof; the average value of the index m of the mid-chain branched alkyl sulfate surfactant is at least about 0.01;

ii) from 0% to 80% by weight, of a mid-chain branched aryl sulfonate surfactant having the formula:

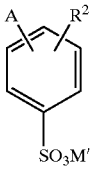

wherein A of the mid-chain branched aryl sulfonate is a mid-chain branched alkyl unit having the formula:

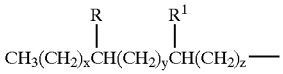

wherein R and $R^1$ of the mid-chain branched aryl sulfonate, are each independently hydrogen, $C_1$–$C_3$ alkyl, and mixtures thereof, provided the total number of carbon atoms in said alkyl unit is from 6 to 18 and at least one of R and $R^1$ of the mid-chain branched aryl sulfonate is not hydrogen; x of the mid-chain branched aryl sulfonate is an integer from 0 to 13; y of the mid-chain branched aryl sulfonate is an integer from 0 to 13; z of the mid-chain branched aryl sulfonate is 0 or 1; $R^2$ of the mid-chain branched aryl sulfonate is hydrogen, $C_1$–$C_3$ alkyl, and mixtures thereof; M' of the mid-chain branched aryl sulfonate is a water soluble cation with sufficient charge to provide neutrality;

iii) optionally from 0.01% by weight, of a surfactant selected from the group consisting of anionic, nonionic, cautionic, zwitterionic, ampholytic surfactants, and mixtures thereof; and c) the balance carriers and adjunct ingredients.

2. A composition according to claim 1 wherein R units of the polyamine are (a)(ii) hydroxyalkylene units.

3. A composition according to claim 1 wherein said $R^2$ of the polyamine is ethylene.

4. A composition according to claim 3 wherein the index m of the polyamine is from 1 to 3.

5. A composition according to claim 1 wherein said polyamine comprises hydroxyalkylene/oxyalkylene R backbone units wherein $R^2$ of the polyamine is selected from the group consisting of ethylene.

6. A composition according to claim 1 wherein said polyamine hydroxyalkylene/oxyalkylene R backbone units of the polyamine have the formula:

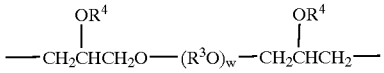

wherein each $R^3$ of the polyamine is independently ethylene, propylene, and mixtures thereof; $R^4$ of the polyamine is hydrogen, $—(R^2O)_fY$, and mixtures thereof; w of the polyamine is from 1 to about 5.

7. A composition according to claim 6 wherein $R^4$ of the polyamine is hydrogen.

8. A composition according to claim 1 comprising from about 0.01% by weight of a mid-chain branched aryl sulphonate surfactant admixture wherein at least one of said surfactants which comprises said admixture comprises R of the mid-chain branched aryl sulphonate surfactant is equal to methyl, $R^1$ of the mid-chain branched aryl sulphonate surfactant is equal to methyl, $R^2$ of the mid-chain branched aryl sulphonate surfactant is equal to hydrogen, and z of the mid-chain branched aryl sulphonate surfactant is equal to 0.

9. A composition according to claim 8 wherein at least 75% of said surfactants which comprise said admixture have $R^1$ of the mid-chain branched aryl sulphonate surfactant is equal to methyl and z of the mid-chain branched aryl sulphonate surfactant is equal to 0.

10. A composition according to claim 1 comprising from about 0.01% by weight of a mid-chain branched alkyl sulfate surfactant admixture wherein at least one of said surfactants which comprises said admixture comprises R of the mid-chain branched alkyl sulfate surfactant is equal to methyl, $R^1$ of the mid-chain branched alkyl sulfate surfactant is equal to hydrogen, $R^2$ of the mid-chain branched alkyl sulfate surfactant is equal to hydrogen, and the sum of w+x+y+z of the mid-chain branched alkyl sulfate surfactant is equal to from 8 to 10.

11. A composition according to claim 10 wherein at least 75% of said surfactants which comprise said admixture have R of the mid-chain branched alkyl sulfate surfactant is equal to methyl and w of the mid-chain branched alkyl sulfate surfactant is equal to 0.

12. A composition according to claim 1 comprising from about 0.01% by weight of a mid-chain branched alkyl alkoxy sulfate surfactant admixture wherein at least one of said surfactants which comprises said admixture comprises R of the mid-chain branched alkyl alkoxy sulfate surfactant is equal to methyl, $R^1$ of the mid-chain branched alkyl alkoxy sulfate surfactant is equal to hydrogen, $R^2$ of the mid-chain branched alkyl alkoxy sulfate surfactant is equal to hydrogen, the sum of w+x+y+z of the mid-chain branched alkyl alkoxy sulfate surfactant is equal to from 8 to 10, and m of the mid-chain branched alkyl alkoxy sulfate surfactant is from 1 to 7.

13. A composition according to claim 12 wherein at least 75% of said surfactants which comprise said admixture have R of the mid-chain branched alkyl alkoxy sulfate surfactant is equal to methyl and w of the mid-chain branched alkyl alkoxy sulfate surfactant is equal to 0.

14. A composition according to claim 13 wherein m of the mid-chain branched alkyl alkoxy sulfate surfactant is from 2 to 5.

15. A composition according to claim 1 comprising from about 0.01% by weight of a surfactant admixture said admixture comprising one or more mid-chain branched alkyl sulfate surfactants and one or more mid-chain branched alkyl alkoxy sulfate surfactants wherein at least one of said surfactants which comprises said admixture comprises R of the mid-chain branched alkyl sulfate or alkyl alkoxy sulfate surfactant is equal to methyl, $R^1$ of the mid-chain branched alkyl sulfate or alkyl alkoxy sulfate surfactant is equal to hydrogen, $R^2$ of the mid-chain branched alkyl sulfate or alkyl alkoxy sulfate surfactant is equal to hydrogen, and the sum of w+x+y+z of mid-chain branched alkyl sulfate or alkyl alkoxy sulfate surfactant is equal to from 8 to 10 and the average value of m of the mid-chain branched alkyl sulfate or alkyl alkoxy sulfate surfactant is from about 0.01 to 10.

16. A composition according to claim 15 wherein at least 75% of said surfactants which comprise said admixture have R of the mid-chain branched alkyl sulfate or alkyl alkoxy sulfate surfactant is equal to methyl and w of the mid-chain branched alkyl sulfate or alkyl alkoxy sulfate surfactant is equal to 0.

17. A composition according to claim 1 further comprising about 1% by weight of a builder.

18. A composition according to claim 1 further comprising from about 1% by weight, of a peroxygen bleaching system comprising:

i) from about 40% by weight, of the bleaching system, a source of hydrogen peroxide;

ii) optionally from about 0.1% by weight, of the beaching system, a beach activator;

iii) optionally from about 1 ppb of the composition, of a transition-metal bleach catalyst; and iv) optionally from about 0.1% by weight, of a pre-formed peroxygen bleaching agent.

19. A laundry detergent composition comprising:

a) from about 0.01% to about 20% by weight, of a polyamine, said polyamine having the formula:

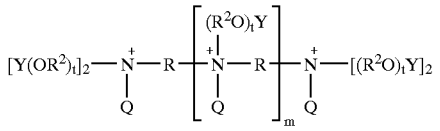

R is a backbone unit selected from the group consisting of:

i) $C_6$–$C_{16}$ substituted or unsubstituted arylene, $C_7$–$C_{40}$ substituted or unsubstituted alkylenearylene having the formula:

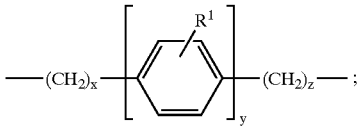

or mixtures thereof:

iii) hydroxyalkylene units having the formula:

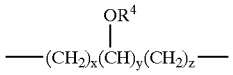

iv) hydroxyalkylene/oxyalkylene units having the formula:

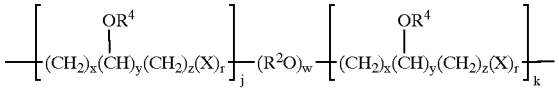

v) carboxyalkyleneoxy units having the formula:

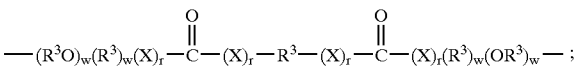

and mixtures thereof;

$R^1$ is selected from the group consisting of:

i) hydrogen;

ii) $C_1$–$C_{22}$ alkyl;

iii) $C_7$–$C_{22}$ arylenealky;

iv) $C_7$–$C_{22}$ alkylenearyl;

v) —$[CH_2CH(OR^4)CH_2O]_s(R^2O)_tY$;

vi) anionic units;

vii) and mixtures thereof;

$R^2$ is selected from the group consisting of ethylene, 1,2-propylene, 1,3-propylene, 1,2-butylene, 1,4-butylene, 1,6hexylene, 1,2-hexylene, 1,4-phenylene, and mixtures thereof;

$R^3$ is $C_2$–$C_8$ linear alkylene, $C_3$–$C_8$ branched alkylene, phenylene, substituted phenylene, and mixtures thereof;

$R^4$ is hydrogen, $C_1$–$C_6$ alkyl, —$(CH_2)_u(R^2O)_t(CH_2)_uY$, and mixtures thereof;

Q is a quaternizing unit selected from the group consisting of $C_1$–$C_4$ linear alkyl, $C_1$–$C_4$ hydroxyalkyl, benzyl, —$[CH_2CH(OR^4)CH_2O]_s(R^2O)_tY$, and mixtures thereof;

X is oxygen, —$NR^4$—, and mixtures thereof;

Y is an anionic unit selected from the group consisting of —$(CH_2)_fCO_2M$, —$C(O)(CH_2)_fCO_2M$, —$(CH^2)_fPO_3M$, —$(CH^2)_fOPO_3M$, —$(CH_2)_fSO_3M$, —$CH_2(CHSO_3M)$—$(CH_2)_fSO_3M$, —$CH_2(CHSO_2M)$—$(CH_2)_fSO_3M$, —$C(O)CH_2CH(SO_3M)CO_2M$, —$C(O)CH_2CH(CO_2M)NHCH$—$(CO_2M)CH_2CO_2M$, —$CH_2CH(OZ)CH_2O(R^1O)_fZ$, —$(CH_2)_fCH[O(R^2O)_fZ]CH_fO$—$(B^2O)_fZ$, and mixtures thereof; wherein Z is hydrogen or an anionic unit selected from the group consisting of —$(CH_2)_fCO_2M$, —$C(O)(CH_2CO_2M$, —$(CH_2)PO_3M$, —$(CH_2)_fOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, $C(O)CH_2CH(CO_2M)NHCH(CO_2M)CH_2CO_2M$, and mixtures thereof; M is hydrogen, a water soluble cation, and mixtures thereof; the index f is from 0 to about 6; the index m is from 0 to 20;

the index j is from 1 to 20; the index k is from 1 to 20; the index r is 0 or 1; the index s is from 0 to 5; the index t has an average value of from about 0.5 to about 100; the index u is from 0 to 6; the index w is from 0 to 25; indices x and z are each independently from 0 to 20 and indice y is from 1 to 20;

b) from about 0.01% to about 60% by weight, of a surfactant system comprising:

i) from 0% to 80% by weight, of a mid-chain branched alkyl sulfate surfactant selected from the group consisting of surfactants having the formula:

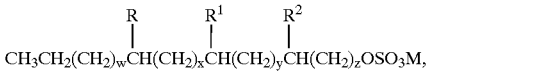

the formula:

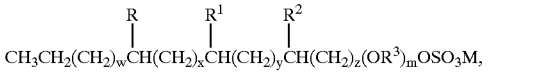

and mixtures thereof; wherein R, $R^1$, and $R^2$ of the mid-chain branched alkyl sulfate surfactant are each independently hydrogen, $C_1$–$C_3$ alkyl, and mixtures thereof, provided the total number of carbon atoms in said surfactant is from 14 to 20 and at least one of R, $R^1$, and $R^2$ of the mid-chain branched alkyl sulfate surfactant is not hydrogen; the index w of the mid-chain branched alkyl sulfate surfactant is an integer from 0 to 13; x of the mid-chain branched alkyl sulfate surfactant is an integer from 0 to 13; y of the mid-chain branched alkyl sulfate surfactant is an integer from 0 to 13; z of the mid-chain branched alkyl sulfate surfactant is an integer of at least 1; provided w+x+y+z of the mid-chain branched alkyl sulfate surfactant is from 8 to 14 and the total number of carbon atoms in a surfactant is from 14 to 20; $R^3$ of the mid-chain branched alkyl sulfate surfactant is ethylene, 1,2-propylene, 1,3-propylene, 1,2-butylene, 1,4-butylene, and mixtures thereof; the average value of the index m of the mid-chain branched alkyl sulfate surfactant is at least about 0.01;

ii) from 0% to 80% by weight, of a mid-chain branched aryl sulfonate surfactant having the formula:

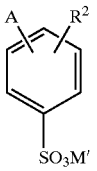

wherein A of the mid-chain branched aryl sulfonate surfactant is a mid-chain branched alkyl unit having the formula:

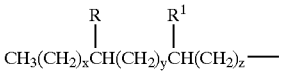

wherein R and $R^1$ of the mid-chain branched aryl sulfonate surfactant are each independently hydrogen, $C_1$–$C_3$ alkyl, and mixtures thereof, provided the total number of carbon atoms in said alkyl unit is from 6 to 18 and at least one of R and $R^1$ of the mid-chain branched aryl sulfonate surfactant is not hydrogen; x of the mid-chain branched aryl sulfonate surfactant is an integer from 0 to 13; y of the mid-chain branched aryl sulfonate surfactant is an integer from 0 to 13; z of the mid-chain branched aryl sulfonate surfactant is 0 or 1; $R^2$ of the mid-chain branched aryl sulfonate surfactant is hydrogen, $C_1$–$C_3$ alkyl, and mixtures thereof; M' of the mid-chain branched aryl sulfonate surfactant is a water soluble cation with sufficient charge to provide neutrality;

iii) optionally from 0.01% by weight, of a surfactant selected from the group consisting of anionic, nonionic, caution, zwitterionic, ampholytic surfactants, and mixtures thereof;

c) from about 1 ppb of the composition, of a transition-metal bleach catalyst;

d) from about 1% by weight, of a builder, and e) the balance carriers and adjunct ingredients.

* * * * *

UNITED STATES PATENT AND TRADEMARK OFFICE

CERTIFICATE OF CORRECTION

PATENT NO. : 6,677,289 B1
DATED : January 13, 2004
INVENTOR(S) : Kenneth Nathan Price et al.

It is certified that error appears in the above-identified patent and that said Letters Patent is hereby corrected as shown below:

Column 65,
Line 64, "O is a quaternizing" should read -- Q is a quaternizing --.

Column 67,
Line 18, "claim 1" should read -- claim 5 --.

Signed and Sealed this

Twenty-seventh Day of April, 2004

JON W. DUDAS
*Acting Director of the United States Patent and Trademark Office*